US011085263B2

(12) United States Patent
Foubister

(10) Patent No.: US 11,085,263 B2
(45) Date of Patent: Aug. 10, 2021

(54) DOWNHOLE APPARATUS

(71) Applicant: Weatherford U.K. Limited, Loughborough (GB)

(72) Inventor: Graeme Foubister, Ellon (GB)

(73) Assignee: Weatherford UK Limited

( * ) Notice: Subject to any disclaimer, the term of this patent is extended or adjusted under 35 U.S.C. 154(b) by 306 days.

(21) Appl. No.: 15/953,030

(22) Filed: Apr. 13, 2018

(65) Prior Publication Data

US 2018/0298710 A1 Oct. 18, 2018

(30) Foreign Application Priority Data

Apr. 13, 2017 (GB) ..... 1705993

(51) Int. Cl.
*E21B 29/00* (2006.01)

(52) U.S. Cl.
CPC ..... *E21B 29/005* (2013.01)

(58) Field of Classification Search
CPC ..... E21B 29/005; E21B 29/002
See application file for complete search history.

(56) References Cited

U.S. PATENT DOCUMENTS 4,674,802 A 6/1987 McKenna et al.
4,887,668 A * 12/1989 Lynde ..... B23B 5/16 166/55.8
4,938,291 A * 7/1990 Lynde ..... B23B 5/16 166/55.8
5,012,863 A 5/1991 Springer
5,070,952 A * 12/1991 Neff ..... E21B 10/322 175/426
5,297,630 A 3/1994 Lynde et al.
5,862,870 A * 1/1999 Hutchinson ..... E21B 29/005 175/269
9,353,589 B2 * 5/2016 Hekelaar ..... E21B 29/005
10,030,459 B2 * 7/2018 Stokes ..... E21B 29/002
10,167,690 B2 * 1/2019 Haq ..... E21B 17/1078
2004/0206547 A1 10/2004 de Luca
2013/0168076 A1 * 7/2013 Davis ..... E21B 29/005 166/55.8
2014/0332200 A1 * 11/2014 Ruttley ..... E21B 29/00 166/55.7

(Continued)

FOREIGN PATENT DOCUMENTS

GB 834870 A 5/1960

OTHER PUBLICATIONS

United Kingdom Combined Search and Examination Report dated Aug. 23, 2017, for Application No. GB1705993.2.

(Continued)

*Primary Examiner* — Caroline N Butcher
(74) *Attorney, Agent, or Firm* — Patterson + Sheridan, LLP

(57) ABSTRACT

A knife for performing a downhole cutting operation includes two spaced-apart blades positioned respectively at a trailing side and leading side of the knife. The blade at the trailing side defines a first cutting element of the knife and the blade at the leading side defines a second cutting element of the knife. The first cutting element extends to a radially outermost position of the knife such that the first cutting element initially cuts a downhole casing during the initial cutting operation of the knife. The second cutting element is not involved in the cutting of the casing during the initial cutting operation.

20 Claims, 11 Drawing Sheets

(56) References Cited

U.S. PATENT DOCUMENTS

| | | | | |
|---|---|---|---|---|
| 2015/0101812 | A1* | 4/2015 | Bansal | E21B 29/002 166/298 |
| 2015/0167394 | A1* | 6/2015 | Xia | E21B 29/002 166/377 |
| 2015/0343536 | A1* | 12/2015 | Ai | B23B 29/24 82/1.11 |
| 2015/0376966 | A1* | 12/2015 | Balasubramanian | E21B 29/005 166/298 |
| 2016/0130899 | A1* | 5/2016 | Cronley | E21B 29/005 166/298 |
| 2017/0122053 | A1* | 5/2017 | Braddick | E21B 23/01 |

OTHER PUBLICATIONS

United Kingdom Office Action dated Feb. 11, 2020, for Application No. GB1705993.2.

* cited by examiner

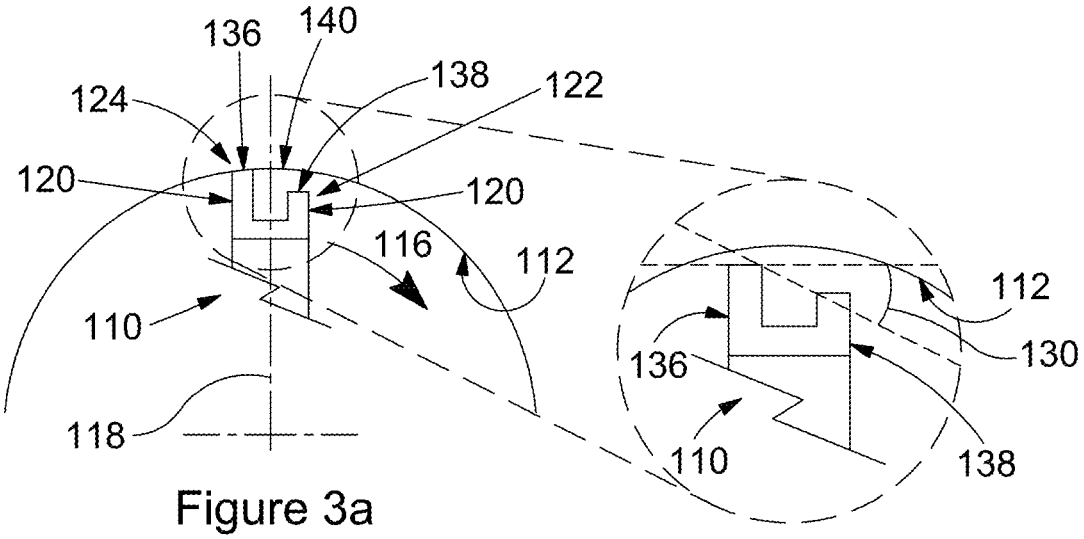
Figure 3a
Figure 3b
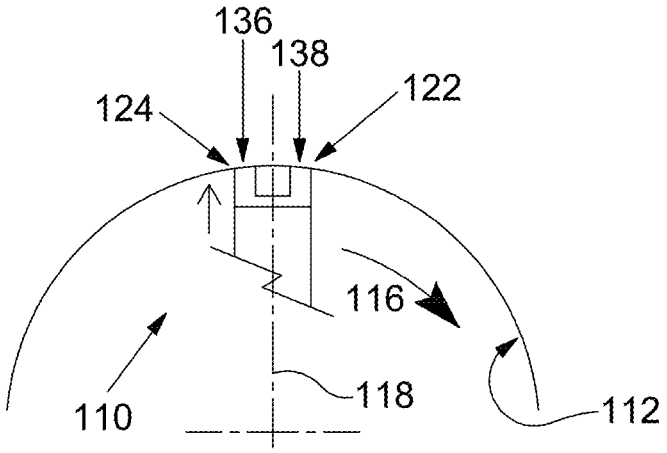
Figure 4

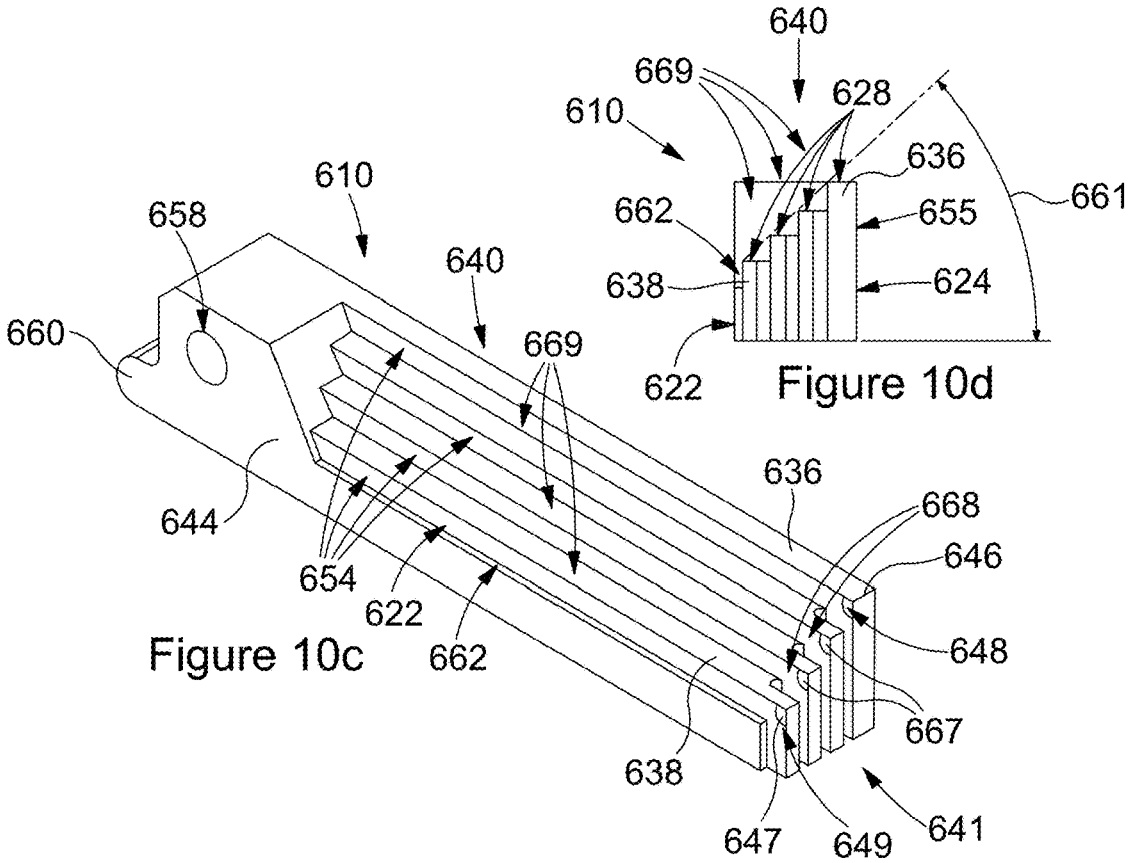
Figure 10d
Figure 10c
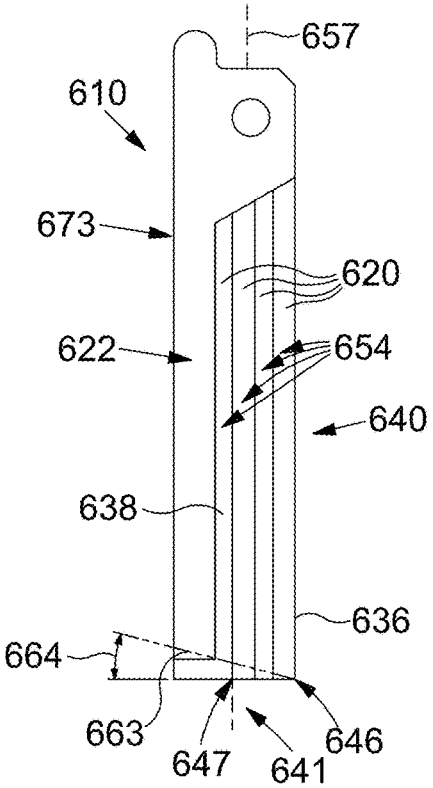
Figure 10a
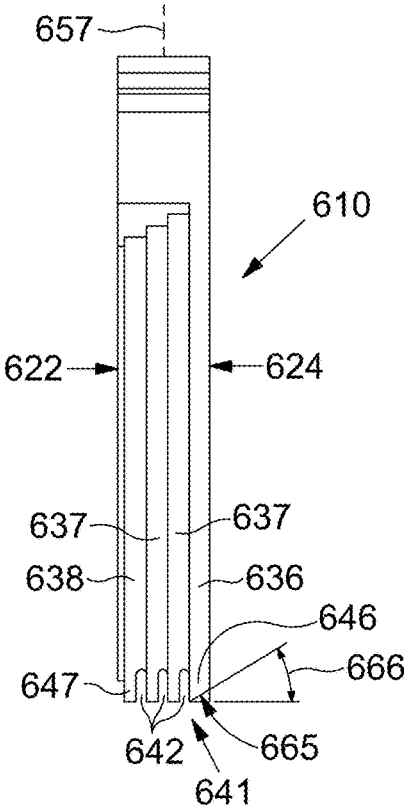
Figure 10b

DOWNHOLE APPARATUS

CROSS-REFERENCE TO RELATED APPLICATIONS

This application claims benefit of United Kingdom patent application number 1705993.2, filed Apr. 13, 2017, which is herein incorporated by reference.

BACKGROUND OF THE INVENTION

Field of the Invention

The present disclosure relates to cutting or milling apparatus and methods, e.g. but not exclusively, for casing cutting, milling, fishing operations, or the like.

Description of the Related Art

It is sometimes necessary to cut or mill various downhole objects, for example, during various well operations such as drilling, completion, intervention or abandonment operations.

In some operations the casing needs to be removed, which typically involves inserting a casing severing tool into the casing, severing the casing and subsequently retrieving the severed casing. Examples of casing severing techniques include explosive, mechanical, chemical, plasma or abrasive methods, which create a radial cut circumferentially around an inner surface of the casing to separate an upper section from a lower section of casing.

The severing and retrieval of casing sections is a time-consuming operation, which sometimes requiring separate tools for performing the severing operation and the casing retrieval operation. Each time a tool has to be retrieved to surface and subsequently followed by a new tool being run downhole, the cost of the operation increases and uses valuable rig time.

An example mechanical severing technique utilises a cutting tool including, for example, tungsten-carbide dressed knives mounted thereon. The knives are moveable into contact with a casing inner surface and rotatable within the casing so as to cut the casing. Currently available knives for cutting casing include a blade having a leading cutting edge, which either slopes away at a negative rake angle towards the trailing side of the blade, or has a flat side (e.g. no rake angle) between the leading and trailing sides. During a cutting operation, the blade wears initially at the leading side and eventually wears towards the trailing side of the blade. Due to the shape of the casing being cut, the cutting surface of the blade tends to form a bearing surface which substantially matches the shape of the casing being cut. If a bearing surface is formed at the cutting surface of the blade, the cutting efficiency may be reduced because the cutting surface grinds against the casing. In this situation, it may be necessary to retrieve the cutting tool to surface, fit new knives, run the cutting tool downhole again, and recommence the cutting operation. FIGS. 1-2 illustrate the formation of a bearing surface on a knife blade and the process of this formation is explained in greater detail below.

FIG. 1 is a downhole view of a knife 10 for cutting a casing 12 in a wellbore 14 during an initial cutting operation. The knife 10 is mounted on a downhole apparatus (not shown) for rotating the knife 10 in a circumferential cutting direction 16. The circumferential cutting direction 16 may define a rotation direction of the knife 10. The knife 10 is run downhole in a radially retracted position. Upon reaching a target location for cutting the casing 12, the knife 10 is moved radially into contact with an inner surface of the casing 12 while rotating the knife 10 relative to the casing 12. The knife 10 defines a centre plane 18 which extends in a radial direction from, and axially along, the downhole apparatus.

The knife 10 includes a single blade 20 which has a leading side 22 for cutting the casing 12 during the initial operation of the knife 10 as illustrated by FIG. 1. The centre plane 18 bisects the blade 20 of the knife 10 between the leading side 22 and the trailing side 24. The knife 10 rotates relative to the casing 12 so that the leading side 22 cuts first during the initial operation of the knife 10. A trailing side 24 of the blade 20 may not be involved in cutting of the casing 12 during the initial operation of the knife 10. The leading side 22 initially defines an outermost cutting surface of the knife 10 in a radial direction that cuts the casing 12 in the radial direction during rotation of the knife 10 relative to the casing 12.

The blade 20 defines a bevelled cutting surface 26 on a cutting surface 28 of the knife 10 which is disposed at a cutting side 40 of the blade 20, the bevelled cutting surface 26 extending between the leading side 22 and trailing side 24. The leading side 22 is to the front of the centre plane 18 and the trailing side 24 is to the rear of the centre plane 18. The bevelled cutting surface 26 extends between the leading side 22 and the trailing side 24 so as to define an "angle of attack" of the blade 20 with the leading side 22 initially cutting into the casing 12. The angle of attack of the bevelled cutting surface 26 may define how sharp or blunt the blade 20 is. A clearance angle 30 is defined between the bevelled cutting surface 26, the leading side 22 and the inner surface of the casing 12. Thus, during the initial operation of the knife 10, the leading side 22 of the blade 20 contacts and cuts the inner surface 18 of the casing 12 while the trailing side 24 of the blade 20 does not make any contact with the inner surface 18. The clearance angle 30 may be regarded as defining a negative rake angle of the blade 20 with respect to the circumferential cutting direction 16.

The blade 20 is dressed (e.g. covered, coated, or the like) with a wear-resistant material 32 including a hardened material such as tungsten carbide so that the blade 20 can cut the relative less hard material (e.g. steel or the like) of the casing 12.

FIG. 2 illustrates the knife 10 of FIG. 1 after the initial cutting operation. As can be seen by comparing FIGS. 1 and 2, the shape of the blade 20 has changed due to the blade 20 being worn by the cutting of the casing 12 during the initial cutting operation.

During operation the knife 10 may be repositioned by moving the blade 20 radially outwardly towards the casing 12 as the blade 20 cuts through the casing 12. If the blade 20 becomes worn during operation, the leading side 22 will be affected initially because it is generally only this part of the blade 20 which is involved with the cutting operation initially. As the leading side 22 is worn away during the cutting operation, a bearing surface 34 is formed at the cutting surface 28 disposed at the cutting side 40 of the blade 20. The bearing surface 34 is rounded and substantially corresponds to (e.g. matches) the shape of the inner surface 18 of the casing 12. Once the bearing surface 34 has been formed, both the leading side 22 and the trailing side 24 of the blade 20 define the cutting side 40 at a radially outermost surface of the knife 10 so that there is no longer any clearance (e.g. the clearance angle 30 is reduced, potentially to zero) between the blade 20 and the casing 12. The bearing surface 34 may reduce the effectiveness of the blade 20 since the blade 34 effectively grinds against the casing 12 instead of efficiently cutting the casing 12. Once the bearing surface 34 has formed on the blade 20, it may be necessary to bring the knife 10 to the surface for replacement, which uses up valuable rig time and increases the cost of the operation.

Although the example of FIGS. 1-2 describes a casing cutting operation, similar issues may arise during a milling operation. In a milling operation, a milling tool includes milling blades oriented for milling in an axial (e.g. a downhole) direction through a wellbore.

SUMMARY OF THE INVENTION

An aspect or embodiment of the present disclosure relates to a knife for cutting or milling an object in a wellbore. The knife may be mountable on a downhole apparatus for moving the knife in a cutting direction. The knife may comprise a first cutting element and a second cutting element. The second cutting element may be spaced apart from the first cutting element such that one of the first and second cutting elements may define a trailing side and the other of the first and second cutting elements may define a leading side with respect to a rotation direction of the knife. One of: the first and second cutting elements may be aligned to cut the object for an initial cutting operation. The other one of: the first and second cutting elements may be aligned to cut the object after the initial cutting operation. The first cutting element may initially extend further from the knife than the second cutting element. The first cutting element may be configured to cut the object for the initial cutting operation during which the first cutting element may be worn down by use such that upon the first cutting element being worn down, the second cutting element may be configured to cut the object after the initial cutting operation.

In use, the knife may be moved towards the object and/or relative to the object in the cutting direction so that one of the cutting elements may contact and cut the object initially. During the initial cutting operation the cutting element for the initial cutting operation may be contactable with the object and the knife may be moved in the cutting direction so that the cutting element may cut or mill the object. During the initial cutting operation the other cutting element may not be involved in cutting or milling of the object. However, after the initial cutting operation, the other cutting element may be in contactable with the object, with the knife being moveable in the cutting direction so that the other cutting element may cut or mill the object. After the initial cutting operation, the cutting element may or may not still cut or mill the object.

By utilising one of the cutting elements during the initial cutting operation, the other one of the cutting elements may be saved for use after the initial cutting operation. During the initial cutting operation the cutting element may become worn out, broken or less effective so that the other cutting element may continue with the cutting or milling of the object after the initial cutting operation, which may increase the lifetime of the knife.

The other one of the cutting elements may be utilised for cutting or milling the object during a subsequent cutting operation after the initial cutting operation. By providing both an initial and subsequent cutting operation, the knife may be useable for a longer period of time. By allowing the knife to be used for a longer period of time, there may be a reduced need to pull the knife out of the wellbore to replace the knife before a cutting or milling operation has been completed.

The first and second cutting elements may comprise a cutting surface configured to cut or mill the object. The position or size of the cutting surface may be dependent on the relative positioning or orientation between the knife and the object.

The first and second cutting elements may each define a blade of the knife. The first and second cutting elements may be mountable on the same knife.

The first and second cutting elements may define a cutting side of the knife. One or both of the first and second cutting elements may define a cutting surface of the knife. The cutting side of the knife may define a side of the knife that is orientable or moveable towards the object.

The cutting element for the initial cutting operation may define an outermost cutting surface for the initial cutting operation. The cutting element for after the initial cutting operation may define an outermost cutting surface for after the initial cutting operation.

The knife may be moveable by displacing or repositioning the knife, changing the orientation or inclination of the knife, or otherwise moving the knife.

The cutting element for the initial cutting operation may protrude or extend further from the knife than the cutting element for cutting the object after the initial cutting operation.

In use, if the knife is moved towards the object, the cutting element aligned to cut the object for the initial cutting operation may initially contact the object due to protruding or extending further from the knife than the other cutting element. The cutting element for the initial cutting operation may be longer than the cutting element for cutting the object after the initial cutting operation.

At least one of the cutting elements may be relatively longer than at least one other of the cutting elements. The longest cutting element may cut the object initially. The at least one other, relatively shorter, cutting elements may cut the object after the initial cutting operation, for example, if the relatively longer cutting element wears sufficiently to allow the shorter cutting element to cut the object (e.g. for after the initial cutting operation). The longer cutting element may be defined as the cutting element that initially contacts and cuts the object (e.g. for the initial cutting operation), if the knife is moveable relative to the downhole apparatus from a non-cutting configuration in which the knife is not in contact with the object to a cutting configuration in which the knife is in contact with the object. The relatively shorter cutting element may be defined as the cutting element that does not initially contact the object if the knife is moveable from the non-cutting configuration to the cutting configuration. The knife may remain in the cutting configuration while the longer cutting element wears down (e.g. for the initial cutting operation), upon which at least one other, shorter, cutting element may then cut the object while the knife is in the cutting configuration (e.g. for after the initial cutting operation).

In an example, the first cutting element may be longer than, protrude or extend further from the knife, than the second cutting element. In another example, the second cutting element may be longer than, protrude or extend further from the knife, than the first cutting element. In another example, at least one cutting element may be longer than, protrude or extend further from the knife, than at least one other cutting element.

The first cutting element may be configured to initially engage the object for the initial cutting operation such that a separation gap may be defined between the object and the second cutting element, wherein in use, the separation gap may decrease as the first cutting element is worn down until the second cutting element may engage the object after the initial cutting operation.

The first cutting element may define an outermost cutting surface of the knife with respect to a pivot point of the knife. The outermost cutting surface of the knife may be configured to engage the object for the initial cutting operation.

The second cutting element may comprise a cutting surface that may be closer to the pivot point than the outermost cutting surface of the first cutting element so that upon the first cutting element being worn down by use in the initial cutting operation, the respective cutting surfaces of the first cutting element and the second cutting element may be equally spaced from the pivot point.

The cutting element for the initial cutting operation may be moveable relative to the object so as to define a first cutting plane. The cutting element for cutting the object after the initial cutting operation may be moveable relative to the object so as to define a second cutting plane.

The first cutting plane may be at least one of: initially different to the second cutting plane; moveable relative to the second cutting plane; moveable towards the second cutting plane during the initial cutting operation; and identical or similar to the second cutting plane.

The first cutting element may be moveable relative to the object during use so as to define a first cutting plane, and the second cutting element may be moveable relative to the object during use so as to define a second cutting plane. The first cutting plane may be at least one of: initially different to the second cutting plane before and during the initial cutting operation; moveable relative to the second cutting plane during the initial cutting operation; moveable towards the second cutting plane during the initial cutting operation; and identical to the second cutting plane after the initial cutting operation.

In use, at least one of the cutting elements may wear such that the cutting plane defined by movement of the cutting element relative to the object may move relatively towards the cutting plane defined by movement of the other cutting element. Movement of the knife relative to or towards the object may at least partially define the cutting plane of the respective cutting elements. Movement of the knife relative to the object may move or sweep the cutting elements in a motion that defines the cutting planes of the cutting elements.

The first and second cutting elements may be aligned such that movement of the knife relative to the object causes at least one of the first and second cutting planes defined by the respective first and second cutting elements to move at least one of: axially and radially relative to wellbore or object.

At least one of the cutting elements may comprise or define a trailing side of the knife with respect to the cutting direction of the knife. At least one of the other cutting elements may comprise or define a leading side of the knife with respect to the cutting direction of the knife. At least one of the cutting elements may comprise one of: the leading and trailing side of the knife. At least one of the cutting elements may comprise one other of: the leading and trailing side of the knife.

In an example, one of the cutting elements may comprise or be disposed at or on the leading side of the knife, and another one of the cutting elements may comprise or be disposed at or on the trailing side of the knife.

At least one of the cutting elements may comprise or define at least one of: a leading face and trailing face with respect to the cutting direction of the knife. The leading face of at least one of the cutting elements may face towards the cutting direction of the knife. The leading face may comprise a cutting surface, corner portion, or the like of the cutting element and/or knife. At least part of the leading face of at least one of the cutting elements may be configured to contact the object during the cutting operation. The leading face of at least one of the cutting elements may comprise or define the leading side of the knife.

The trailing face of at least one of the cutting elements may face backwards to the cutting direction of the knife. The trailing face may comprise a cutting surface, corner portion, or the like of the cutting element and/or knife. The trailing face of at least one of the cutting elements may comprise or define the trailing side of the knife.

The knife may be configured to cut the object in at least one of: an axial cutting direction and a radial cutting direction within the wellbore.

The knife may be configured such that movement of the knife in the rotation direction and movement of the knife in at least one of: the axial cutting direction and the radial cutting direction may cut the object.

The first and second cutting elements may be circumferentially spaced apart from each other with respect to the rotation direction.

The first and second cutting elements may be arranged to define a positive rake angle for allowing wearing of the knife from the trailing side to the leading side. The first and second cutting elements may be arranged to define a negative rake angle for allowing wearing of the knife from the leading side to the trailing side.

During the initial cutting operation, the knife may be initially worn or eroded at the trailing side or the leading side. After the initial cutting operation, the knife may subsequently be worn at the leading side or trailing side, respectively.

The positive or negative rake angle may define an angle of attack of the knife. The angle of attack may be defined between the second cutting element, the first cutting element, and the object, or may be defined between the first cutting element, the second cutting element, and the object. The angle of attack of the knife may be oriented away from the object so that the trailing side instead of the leading side may cut the object initially. The angle of attack of the knife may be oriented towards the object so that the leading side instead of the trailing side may cut the object initially.

Depending on the knife cutting direction, either one of: the first and second cutting elements may comprise or define the leading side of the knife. For example, if the knife is moveable in a first cutting direction, one of: the first and second cutting elements may comprise or define the leading side of the knife and the other one of: the first and second cutting elements may comprise or define the trailing side of the knife. Further, if the knife is moveable in a second cutting direction, e.g. in a direction that is opposite to the first cutting direction, one of: the first and second cutting elements may comprise or define the trailing side of the knife and the other one of: the first and second cutting elements may comprise or define the leading side of the knife. The first cutting direction may be defined by movement of the knife in one of: a clockwise and anticlockwise cutting direction of the knife when viewed downhole. The second cutting direction may be defined by movement of the knife in the other one of: the clockwise and anticlockwise cutting direction of the knife when viewed downhole.

In an example, the first cutting element may define the trailing side of the knife and the second cutting element may define the leading side of the knife if moving the knife in a clockwise cutting direction when viewed downhole. However, in this example, if moving the knife in an anticlockwise cutting direction when viewed downhole, the first cutting element may define a leading side and the second cutting element may define a trailing side. Thus, depending on the cutting direction, either one of: the first and second cutting elements may comprise or define the leading and trailing sides of the knife.

In an example, at least one cutting element may comprise or define a leading face of the knife, for example, if a part or surface of the at least one cutting element moves towards the cutting direction. In another example, at least one cutting element may not comprise or define a leading face of the knife, for example, if no part or surface of the at least one cutting element moves towards the cutting direction.

In an example, at least one cutting element may comprise or define a trailing face of the knife, for example, if a part or surface of the at least one cutting element moves backwards to the cutting direction. In another example, at least one cutting element may not comprise or define a trailing face of the knife, for example, if no part or surface of the at least one cutting element moves backwards to the cutting direction.

The cutting element for the initial cutting operation may be staggered or extend or protrude to a different position relative to the cutting element for after the initial cutting operation so that the cutting element for the initial cutting operation may define an initial cutting surface of the knife and the cutting element for after the initial cutting operation may define a subsequent cutting surface of the knife.

One of: the first and second cutting elements may be longer than, protrude or extend further from the knife, than the other one of: the first and second cutting elements. The longer cutting element may be defined as the cutting element that initially contacts and cuts the object (e.g. for the initial cutting operation).

Staggering the cutting elements relative to each other, or providing the cutting elements as extending or protruding to different positions, may provide or define a positive or negative rake angle. The first and second cutting elements may be staggered in terms of: position, relative displacement, orientation, inclination, or the like.

The cutting element for the initial cutting operation (e.g. the first cutting element) may be wearable or erodible for forming a bearing surface during the initial cutting operation. The cutting element for after the initial cutting operation (e.g. the second cutting element) may be configured for cutting a path in the object for allowing the first cutting element comprising the bearing surface to follow in the path after the initial cutting operation.

After the wearing of the cutting element, the other cutting element may define a new or fresh cutting surface for after the initial cutting operation. By providing a new or fresh cutting surface, the formation of a bearing surface may be reduced or may occur at a reduced rate so that the cutting surface may define a smaller surface area for contacting and cutting the object than the example where a larger surface area cutting surface is formed. A reduced surface area at the cutting surface for contacting and cutting the object may increase the efficiency of the cutting operation, which may increase the lifetime of the knife and/or may result in less internal wear on other components due to the reduction in force required to perform the cutting operation.

The knife may define a centre plane between the first and second cutting elements. In an example, if the knife moves in the cutting direction so that the cutting element defines the trailing side of the knife, the cutting element may be disposed behind the centre plane with respect to the cutting direction. If the knife moves in the cutting direction so that the other cutting element defines the leading side of the knife, the other cutting element may be disposed in front of the centre plane with respect to the cutting direction. If a bearing surface forms on the cutting element then the other cutting element may provide improved cutting performance, for example, due to being positioned in front of the centre plane of the knife. The centre plane may bisect the first and second cutting elements.

The knife may comprise at least one cutting side. The cutting side may comprise at least one of the first and second cutting elements. The cutting side may define a portion of the knife which may be positioned or oriented to face the object. The knife may comprise a first cutting side and a second cutting side. At least part of the cutting side may extend between the leading and trailing faces of the cutting element. At least part of the cutting side may extend between adjacent faces of the cutting element, for example, between adjacent leading faces of the cutting element or knife.

It will be appreciated that in an example, only one of the first and second cutting sides may be involved in a cutting operation. However in another example, both of the first and second cutting sides may be involved in a cutting operation.

The knife may be oriented such that the first and second cutting elements may define at least one of: an axial and radial cutting surface of the knife. The knife may be mounted on a downhole apparatus in such a manner that the knife is orientable with the first and second cutting sides respectively defining axial and radial cutting surfaces of the knife with respect to the downhole apparatus.

The knife may comprise at least one further cutting side, for example, in addition to the first and second cutting sides.

The first cutting element may comprise a first corner portion disposed on or along at least one cutting side of the knife. The second cutting element may comprise a second corner portion disposed on or along at least one cutting side of the knife.

The first cutting element may comprise a first corner portion disposed between a first cutting side and second cutting side of the knife. The second cutting element may comprise a second corner portion disposed between the first cutting side and second cutting side of the knife.

The corner portions of the first and second cutting elements may be disposed along the same or a different cutting side of the knife.

At least one of the corner portions may be disposed between the cutting side of the knife and a non-cutting side of the knife, for example, the non-cutting side may be configured to face away from the object so as to not be directly involved with the cutting operation. At least one of the corner portions may define an acute angle between the first cutting side and the second cutting side.

At least one of the corner portions may be disposed between the cutting side of the knife and the leading face of the knife. The leading face may be disposed on or facing towards the leading side of the knife.

At least one of the corner portions may be disposed between the cutting side of the knife and the trailing face of the knife. The trailing face may be disposed on or facing towards the trailing side of the knife.

The cutting element for the initial cutting operation may comprise a first corner portion disposed between the first cutting side and second cutting side of the knife. The cutting element for after the initial cutting operation may comprise a second corner portion disposed between the first cutting side and second cutting side of the knife.

The first corner portion may define an initial cutting surface of the knife for the initial cutting operation. The second corner portion may define a further cutting surface of the knife for after the initial cutting operation. By providing the cutting surface on at least one of the first and second corner portions, the knife may be moveable such that said at least one of the first and second corner portions defines an initial contact surface of the knife if moving the knife into contact with the object, which may minimise angular movement or inclination of the knife required if moving the knife from a retracted position in the downhole apparatus to an extended position in contact with the object. Minimising the degree of angular movement or inclination of the knife required to bring the initial or further cutting surface into contact with the object may ensure that the most appropriate cutting surface (e.g. the sharpest, or the like) of the knife may be contactable with the object, for example, if there is not much space, e.g. annular space, between the downhole apparatus and the downhole object (e.g. in a tight casing, or the like).

At least one of the first and second corner portions may define an angular cutting portion of the knife. At least one of the corner portions may define an acute angle. The acute angle may be between 0 and 90 degrees, and/or may be equal to or less than 90 degrees.

At least one of the corner portions may define an obtuse angle. The obtuse angle may be equal to or more than 90 degrees. The obtuse angle may be equal to or less than 180 degrees.

At least one of the corner portions may define a smaller angle than another of the corner portions.

At least one corner portion may be disposed at a different position relative to another corner portion so that at least one of the corner portions defines an initial cutting surface for the initial cutting operation and another of the corner portions defines a further cutting surface for after the initial cutting operation.

The first cutting element may be staggered relative to the second cutting element so as to define different relative positions of the first and second corner portions.

The first cutting element may have a different dimension, for example a different length or the like, to the second cutting element so as to define the different relative positions of the first and second corner portions. The first cutting side may comprise first and second cutting elements having different dimensions, for example, lengths or the like. The second cutting side may comprise first and second cutting elements having different dimensions, for example, lengths or the like.

The knife may comprise at least one bevelled portion extending along at least one cutting side of the knife. At least one of the first and second cutting elements may comprise a bevelled portion. The first cutting side may comprise the bevelled portion and a non-bevelled portion. The second cutting side may comprise the bevelled portion and a non-bevelled portion.

The knife may comprise at least one non-bevelled portion extending along said at least one cutting side of the knife. The bevelled portion may extend angularly from the knife relative to the non-bevelled portion.

The bevelled portion may extend from at least one of the first and second corner portions to another portion along said at least one the cutting side of the knife.

The bevelled portion may extend between at least one of the first and second corner portions and a bevel transition portion. The bevel transition portion may be defined at any point along said at least one cutting side. The bevel transition portion may define a change in the angle of at least one of the first and second cutting elements along said at least one cutting side. The bevel transition portion may be between the bevelled portion and the non-bevelled portion.

The first cutting element may be spaced apart from the second cutting element.

A space may be defined between the first and second cutting elements. The provision of the space may provide a channel for fluid flow, such as mud flow, between the first and second cutting elements which may contribute to lubrication and/or cooling of the first and second cutting elements during a cutting operation. Lubrication of the first and second cutting elements may ease the movement of said cutting elements over the object while in contact with a surface thereof. Cooling of the first and second cutting elements may reduce thermal wear and/or degradation thereof, which may help to extend the lifetime of the knife.

The first and second cutting elements may be generally parallel relative to each other so as to define the space therebetween. The first and second cutting elements may be arranged such that the space extends at least partially along at least one cutting side of the knife.

At least one of the first and second cutting elements may comprise at least one step. The step may extend at least partially along at least one cutting side of the knife.

The step may extend at least partially along at least one of the first and second cutting sides of the knife. The first cutting side of the knife may define an edge of the step. The second cutting side may define an edge of the step.

The first and second cutting elements may be staggered relative to each other in a step-like or stepped formation.

The at least one step may connect the first cutting element to the second cutting element.

The at least one step may define at least part of at least one of the first and second cutting elements. The step may comprise a face of a cutting side of the knife.

At least one face of the cutting side of the knife may be parallel to another face of the cutting side of the knife. For example the face on the first cutting element that is on the cutting side of the knife may be parallel to the face on the second cutting element that is also on the cutting side of the knife. In another example, at least some of the faces of the cutting side of the knife may be non-parallel to each other.

The step may comprise a leading face extending between the first and second cutting elements. The leading face may be disposed on the leading side of at least one of the first and second cutting elements.

At least one cutting element may comprise or define a leading face of the knife. At least one cutting element may comprise or define a trailing face of the knife. The same or a different cutting element may comprise the leading and trailing faces of the knife.

The knife may be moveable in the cutting direction so that one of: the leading face and the trailing face of at least one of the cutting elements may face towards the cutting direction and so that the other one of: the leading face and the trailing face of at least one of the cutting elements may face backwards to the cutting direction.

The leading face may face towards the cutting direction of the knife. At least part of the leading face may be configured to contact the object during the cutting operation.

The leading face may connect the faces of the cutting side of the knife. At least one leading face may connect the face of the cutting side of the first cutting element with the face of the cutting side of the second cutting element.

The leading face may be perpendicular to the faces of the cutting side. The leading face may extend perpendicularly between the faces of the first and second cutting elements. The faces may extend at least partially along at least one cutting side of the knife. The leading face may extend between the faces of the cutting side at any appropriate angle.

The step may comprise a trailing face extending between the first and second cutting elements. The trailing face may be disposed on the trailing side of at least one of the first and second cutting elements.

The first and second cutting elements may comprise at least one bevelled surface. The at least one bevelled surface may define a relief rake angle along at least one of the first and second cutting elements. At least one bevelled surface may be oriented to face towards the cutting direction of the knife, e.g. at an angle thereto. At least one bevelled surface may be oriented to face backwards to the cutting direction of the knife, e.g. at an angle thereto. At least one bevelled surface may comprise or at least partially define at least one of: a leading and trailing face of the cutting element.

The relief rake angle may be a positive rake angle. The relief rake angle may be a negative rake angle. The relief rake angle may define an angle of attack of the bevelled portion.

The bevelled surface may define an acute angle relative to an adjacent surface of the first and second cutting elements.

The knife may comprise a mount for mounting the knife to the downhole apparatus so that the knife is moveable by a first distance into contact with the object by a moving a portion of the knife relative to the mount by a second distance. The first distance may be greater than the second distance.

The mount may be spaced from the initial cutting surface. The mount may define a pivot or pivot point of the knife.

The mount may be located near a distal end of the knife. The distal end of the knife may be defined as being distal from an initial cutting surface of the knife. By locating the mount distal from the initial cutting surface, a relatively small degree of movement of the knife near to the mount may cause a relatively larger degree of movement of the knife at the initial cutting surface.

The knife may comprise an engagement surface for engaging a movement apparatus for moving the knife relative to the downhole apparatus. The engagement surface may be located at or near the distal end of the knife. The engagement surface may comprise a cam.

At least one of the first and second corner portions may be disposed on the knife at a position such that movement of the knife causes at least one of said first and second corner portions to come into contact with the object. At least one of the first and second corner portions may be defined as being proximal to the initial cutting surface.

The knife may comprise at least one intermediate cutting element disposed between the first and second cutting elements. The intermediate cutting element or elements may comprise the same or similar features to those of the first and second cutting elements. The relationship between the intermediate cutting element or cutting elements and the first and second cutting elements may be the same or similar to the relationship between the first and second cutting elements.

The at least one intermediate cutting element may be configured to cut the object after the initial cutting operation.

The intermediate cutting element may be configured to cut the object after the initial cutting operation such that upon the first cutting element being worn down, the intermediate cutting element may be configured to cut the object and may be worn down by use such that upon the intermediate cutting element being worn down, the second cutting element may be configured to cut the object.

At least one of: the first, intermediate and second cutting elements may be aligned to cut the object for the initial cutting operation. The other of: the first, intermediate and second cutting elements may be aligned to cut the object after the initial cutting operation.

The intermediate cutting element may comprise at least one feature that is the same or similar to at least one feature of at least one of the first and second cutting elements. The at least one intermediate cutting element may be structurally related to the first and second cutting elements in the same or a similar manner to the way in which the first and second cutting elements may be structurally related to each other.

By providing at least one further cutting element, e.g. in the form of at least one intermediate cutting element, the lifetime of the knife may be extended as there may be at least one more cutting surface available, which may take a longer amount of time to wear down in total.

Any number of intermediate cutting elements may be provided, where each cutting element may provide a progressively different outermost cutting portion between the first cutting element and the second cutting element. The intermediate cutting element may extend or protrude from the knife less than the cutting element for the initial cutting operation, for example, the intermediate cutting element may be shorter than the cutting element for the initial cutting operation. The intermediate cutting element may extend or protrude from the knife more than the cutting element for after the initial cutting operation, for example, the intermediate cutting element may be longer than the cutting element for after the initial cutting operation.

At least one of: the first, intermediate, and second cutting elements may be longer than, protrude or extend further from the knife, than at least one other of: the first, intermediate, and second cutting elements. The longer cutting element, or the cutting element that otherwise protrudes or extends further from the knife than at least one other cutting element may be defined as the cutting element that initially contacts and cuts the object (e.g. for the initial cutting operation), if the knife is moveable relative to the downhole apparatus from a non-cutting configuration in which the knife is not in contact with the object to a cutting configuration in which the knife is in contact with the object.

In an example, the first cutting element may be longer than, protrude or extend further from the knife, than the second cutting element. In another example, the second cutting element may be longer than, protrude or extend further from the knife, than the first cutting element. In another example, the first cutting element may be longer than, protrude or extend further from the knife, than at least one intermediate cutting element. In another example, the second cutting element may be longer than, protrude or extend further from the knife, than at least one intermediate cutting element. In another example, at least one intermediate cutting element may be longer than, protrude or extend further from the knife, than at least one of: the first cutting element; the second cutting element; and at least one other intermediate cutting element. In an example, at least two of the cutting elements may be the same length and at least one other cutting element may have a different length.

The intermediate cutting element may define a blade of the knife.

The at least one intermediate cutting element may comprise or define at least one cutting side of the knife. The at least one intermediate cutting element may comprise a first cutting side and a second cutting side. The at least one intermediate cutting element may comprise or define at least one of: a leading face and trailing face of the knife.

The intermediate cutting element may comprise an intermediate corner portion disposed along at least one cutting side of the knife. The intermediate corner portion may be disposed between the first and second corner portions of the knife. A plurality of intermediate corner portions may be disposed between the first and second corner portions of the knife.

The intermediate cutting element may be spaced apart from at least one of: another intermediate cutting element, the first cutting element and the second cutting element.

The at least intermediate cutting element may comprise at least one step.

The at least one step may connect the first cutting element to the second cutting element. The at least one step may connect the first cutting element to the intermediate cutting element. The at least one step may connect the intermediate cutting element to the second cutting element. If there is more than one intermediate cutting element, at least one step may connect at least one intermediate cutting element to another intermediate cutting element.

At least one cutting element may extend or protrude further than at least one other cutting element of the knife e.g. so as to define an outermost cutting surface of the knife or so as to be aligned to cut the object for the initial cutting operation. In one example, the first cutting element or the second cutting element may be aligned to cut the object for the initial cutting operation. In another example, one or more intermediate cutting element may be aligned to cut the object for the initial cutting operation, e.g. instead of the first cutting element or the second cutting element. One or more of any remaining intermediate cutting elements and/or the first and/or second cutting elements may be aligned to cut the object after the initial cutting operation. Any one of the cutting elements of the knife may be aligned to cut the object in any particular order or sequence, e.g. by wearing away any of the cutting elements of the knife in any particular order or sequence.

At least one of the first, intermediate and second cutting elements may comprise at least one bevelled surface. The at least one bevelled surface may define a relief rake angle along at least one of the first, intermediate and second cutting elements.

The knife may comprise a wear-resistant material for dressing a surface of the knife. The knife may comprise a wear-resistant material. The wear-resistant material may comprise a material that is relatively harder than the object being cut or milled. The wear-resistant material may comprise carbide, tungsten carbide, diamond, or any other appropriate material for downhole cutting or milling operations.

Any appropriate technique may be used to dress the knife with the wear-resistant material. The knife may be dressed with a mesh. The mesh may comprise any appropriate material, for example, bronze, steel, titanium, resin, fibres, reinforced fibres, metal, metal power, metal alloy, metal allow powder, or the like. The mesh may comprise at least one material for providing a cutting portion of the mesh. The cutting portion may comprise a block, strand, or other element enclosed, encased or otherwise disposed in the mesh. The cutting portion may comprise carbide, tungsten carbide, or the like.

The knife may comprise at least one anchor for attaching, for example by welding or the like, to a surface of the knife. The anchor may comprise a wear-resistant material, for example, carbide, tungsten carbide, or the like. The anchor may comprise a carbide insert, or the like. The anchor may be disposed on a leading face of the knife. The anchor may be disposed on a cutting side of the knife. The anchor may be disposed on a trailing face of the knife.

It will be appreciated that the knife may be configured to perform a cutting or milling operation or any other operations for removing material from an object in a wellbore.

An aspect or embodiment of the present disclosure relates to downhole apparatus for performing at least one of: a downhole cutting operation and a downhole milling operation. The downhole apparatus may comprise any knife described herein.

An aspect or embodiment of the present disclosure relates to cutting apparatus for performing a downhole cutting or milling operation. The cutting apparatus may comprise the first and second cutting elements according to any example, aspect or embodiment of the present disclosure. The cutting apparatus may comprise at least one of the first, intermediate and second cutting elements according to any example, aspect or embodiment of the present disclosure.

The first and second cutting elements may be mountable on the cutting apparatus in any appropriate way. The first and second cutting elements may form part of the cutting apparatus, or may form part of the knife, e.g. a common knife. For example, any feature of the knife of any aspect or embodiment described in the present disclosure may be combined with any feature of the cutting apparatus. The first and second cutting elements may be mounted to the cutting apparatus in any appropriate way. The cutting apparatus may comprise at least one intermediate cutting element according to any example, aspect or embodiment of the present disclosure.

An aspect or embodiment of the present disclosure relates to milling apparatus for performing a downhole milling or cutting operation. The milling apparatus may comprise the first and second cutting elements according to any example, aspect or embodiment of the present disclosure. The milling apparatus may comprise at least one of the first, intermediate and second cutting elements according to any example, aspect or embodiment of the present disclosure.

One of the cutting elements may be configured for cutting the object during an initial milling operation. The other of the cutting elements may be configured for cutting the object after the initial milling operation. The first cutting element may define a trailing side and the second cutting element may define a leading side with respect to a milling direction of the knife. The second cutting element may define a trailing side and the first cutting element may define a leading side with respect to a milling direction of the knife.

An aspect or embodiment of the present disclosure relates to a cutting apparatus for cutting or milling an object in a wellbore. The cutting apparatus may be mountable on a downhole apparatus for moving the cutting apparatus. The cutting apparatus may comprise a first cutting element for cutting or milling the object. The first cutting element may be configured to cut or mill the object during an initial cutting operation. The cutting apparatus may comprise a second cutting element. The second cutting element may be configured to cut or mill the object after the initial cutting operation. The cutting apparatus may be moveable relative to the object or wellbore such that the first cutting element defines a trailing side of the cutting apparatus. The second cutting element may be moveable relative to the object or wellbore such that the second cutting element defines a leading side of the cutting apparatus.

The cutting apparatus may comprise a knife according to any example, aspect or embodiment of the present disclosure. The first and second cutting element may comprise a blade or cutting element according to any example, aspect or embodiment of the present disclosure.

An aspect or embodiment of the present disclosure relates to a knife for cutting or milling an object in a wellbore. The knife may be mountable on a downhole apparatus for moving the knife in a cutting direction. The knife may comprise a first cutting element, at least one intermediate cutting element, and a second cutting element. At least one of: the first, intermediate and second cutting elements may be aligned to cut the object for an initial cutting operation. At least one other of: the first, intermediate and second cutting elements may be aligned to cut the object after the initial cutting operation.

An aspect or embodiment of the present disclosure relates to a method of cutting or milling a downhole object in a wellbore. The method may comprise providing a cutting element for an initial cutting operation and at least one other cutting element for after the initial cutting operation. The method may comprise engaging the cutting element for the initial cutting operation with the downhole object and moving the cutting element relative to the downhole object so that the cutting element initially cuts the downhole object.

An aspect or embodiment of the present disclosure relates to a method of cutting or milling a downhole object in a wellbore. The method may comprise providing a knife. The knife may comprise a first cutting element and a second cutting element. The second cutting element may be spaced apart from the first cutting element such that one of the first and second cutting elements may define a trailing side and the other of the first and second cutting elements may define a leading side with respect to a rotation direction of the knife. The first cutting element may initially extend further from the knife than the second cutting element. The first cutting element may be configured to cut the object for an initial cutting operation and the second cutting element may be configured to cut the object after the initial cutting operation. The method may comprise engaging the knife with the downhole object. The method may comprise moving the knife in a cutting direction so that the first cutting element may initially cut the downhole object for the initial cutting operation during which the first cutting element may be worn down by use such that upon the first cutting element being worn down, the second cutting element may be configured to cut the object after the initial cutting operation.

The method may comprise moving the knife in at least one of: an axial cutting direction and a radial cutting direction within the wellbore to cut the object.

The cutting element for the initial cutting operation may comprise at least one of: a first, intermediate and second cutting element of a knife. The cutting element for after the initial cutting operation may comprise at least one other of: the first, intermediate and second cutting element of the knife. The first, intermediate and/or second cutting elements may comprise at least one feature of any other first, intermediate and/or second cutting element of any other aspect or example of the present disclosure.

The method may comprise moving the cutting element in a cutting direction so that the cutting element defines a positive rake angle with respect to the cutting direction. The method may comprise moving the cutting element in a cutting direction so that the cutting element defines a negative rake angle with respect to the cutting direction.

The method may comprise moving the cutting element for the initial cutting operation relative to the object so as to define a first cutting plane. The method may comprise moving the cutting element for cutting the object after the initial cutting operation relative to the object so as to define a second cutting plane.

The first cutting plane may be at least one of: initially different to the second cutting plane; moveable relative to the second cutting plane; moveable towards the second cutting plane during the initial cutting operation; and identical or similar to the second cutting plane.

The first and second cutting elements may be aligned such that movement of the knife relative to the object causes at least one of the first and second cutting planes defined by the respective first and second cutting elements to move at least one of: axially and radially relative to wellbore or object.

The method may comprise engaging the cutting element with the downhole object and moving the cutting element relative to the downhole object to initially cut the downhole object for the initial cutting operation. The cutting element may comprise the trailing side of the knife. The cutting element may comprise the leading side of the knife.

The method may comprise engaging the cutting element with the downhole object and moving the cutting element relative to the downhole object to initially cut the downhole object for the initial cutting operation. The cutting element may comprise at least one of: a leading face oriented to face towards a cutting direction of the knife; and a trailing face oriented to face backwards to the cutting direction of the knife.

The method may comprise moving the knife relative to the wellbore in at least one of: a clockwise; and an anticlockwise direction when viewed downhole. The leading and trailing faces of the at least one cutting element may be defined by whether the knife is moved in at least one of: the clockwise and anticlockwise direction. In an example, if the knife is moved in the clockwise direction, at least one cutting element may comprise at least one leading face of the knife. If the knife is moved in the anticlockwise direction, at least one other face may comprise or define at least one leading face of the at least one cutting element. Depending on whether the knife is moveable clockwise or anticlockwise, at least one face of at least one cutting element may define either one of: a leading and trailing face of the cutting element.

The method may comprise wearing down the cutting element by performing the initial cutting operation so as to form a bearing surface on a cutting surface of the cutting element.

The method may comprise engaging the other cutting element with the downhole object and moving the at least one other cutting element relative to the downhole object to cut the downhole object after the initial cutting operation, wherein the at least one other cutting element may comprise a leading side of the knife, or wherein the at least one other cutting element may comprise a trailing side of the knife.

The method may comprise cutting a path in the downhole object with the at least one other cutting element so as to allow the cutting element for the initial cutting operation to follow in the path.

The method may comprise engaging at least one of: a first, intermediate, and second cutting element with the downhole object after performing the initial cutting operation and moving the at least one of: the first, intermediate, and second cutting element relative to the downhole object to cut the downhole object after the initial cutting operation.

The method may comprise cutting a path in the downhole object with the at least one of: the first, intermediate, and second cutting element so as to allow the cutting element for the initial cutting operation to follow in the path.

The method may comprise cutting a path in the downhole object with the at least one other cutting element so as to allow at least one cutting element for the initial cutting operation and/or one or more other cutting elements to follow in the path.

The method may comprise cutting the downhole object with the at least one of: the first, intermediate, and second cutting element before cutting the downhole object with the at least one other cutting element. The at least one other cutting element may comprise one or more of the first, intermediate, and second cutting elements.

The method may comprise cutting the downhole object with the intermediate cutting element and then cutting the downhole object with a further intermediate cutting element.

The method may comprise wearing down at least one of: the at least one of: the first, intermediate, and second cutting element; and the at least one other cutting element by cutting the object after the initial cutting operation so as to form a bearing surface on a cutting surface of the at least one of: the at least one of: the first, intermediate, and second cutting element; and the at least one other cutting element.

The method may comprise moving at least one of the cutting elements in at least one of: a radial direction and a downhole direction with respect to a downhole apparatus so as to cut or mill the downhole object.

The method may comprise providing a knife according to any aspect, example or embodiment of the present disclosure. The cutting element may comprise at least one of the first, intermediate and second cutting elements according to any example, aspect or embodiment of the present disclosure. The first, intermediate and second cutting element may comprise a blade according to any example, aspect or embodiment of the present disclosure.

It should be understood that any one or more of the features of any one or more of the disclosed examples, aspects and/or embodiments of the present disclosure may apply alone or in any combination in relation to any one or more of the other examples, aspects and/or embodiments of the present disclosure.

BRIEF DESCRIPTION OF THE DRAWINGS

These and other aspects or embodiments of the present disclosure will now be described with reference to the accompanying drawings, in which:

FIG. 3*b* is an expanded view of a portion of the knife of FIG. 3*a;*

FIG. 4 is a further schematic downhole view of the knife of FIG. 3*a* after the initial stage of the cutting operation;

FIG. 3*aa* is a downhole view schematically illustrating a knife according to an example of the present disclosure during an initial stage of a downhole cutting operation;

FIG. 10*a* is a side view of a knife according to an example of the present disclosure;

FIG. 10*b* is a further side view of the knife of FIG. 10*a;*

FIG. 10*c* is a perspective view of the knife of FIG. 10*a;*

FIG. 10*d* is a further side view of the knife of FIG. 10*a;*

DETAILED DESCRIPTION

Figure 2:
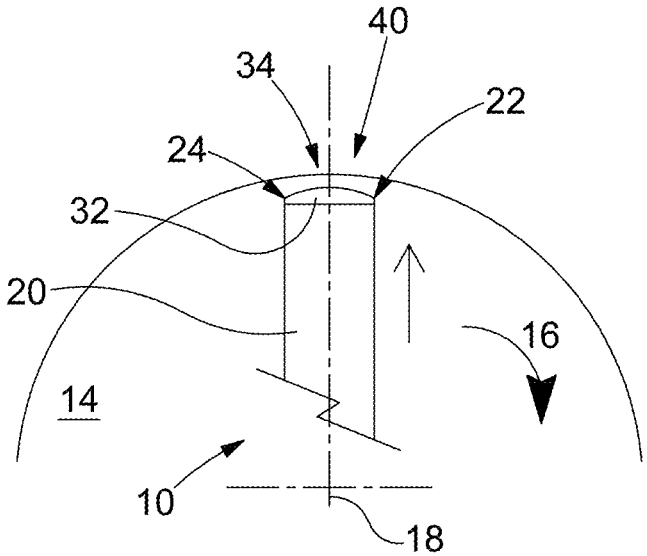
FIG. 2 is a further downhole view of the knife of FIG. 1 after the initial stage of the cutting operation.
Figure 3A:
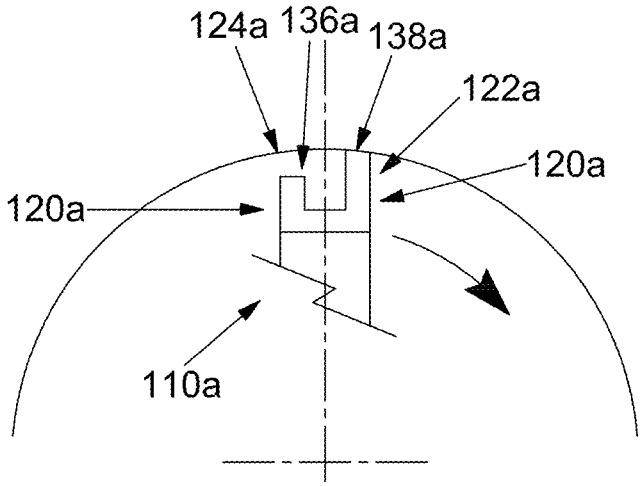
FIG. 3*a* is a downhole view schematically illustrating a knife according to an example of the present disclosure during an initial stage of a downhole cutting operation.
Figure 4A:
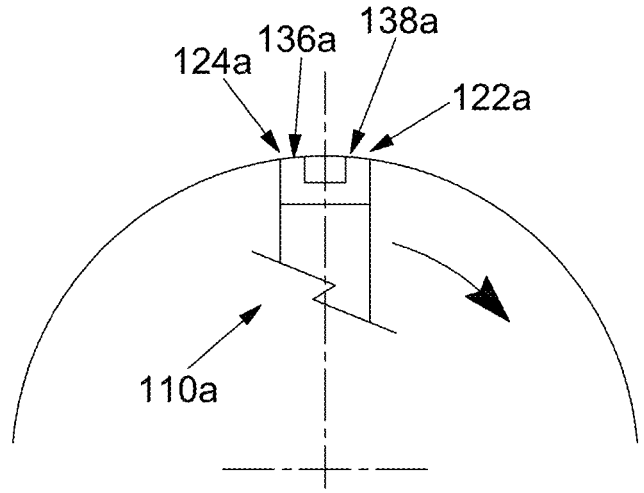
FIG. 4*a* is a further schematic downhole view of the knife of FIG. 3*aa* after the initial stage of the cutting operation.

FIGS. 3*a-b*, 4, 3*aa*, 4*a* & 5*a*-5*c* illustrate a knife 110 according to an example of the present disclosure. The reference signs for features of the knife 110 which are similar to features of the knife 10 of FIGS. 1-2 are incremented by 100.

Figure 1:
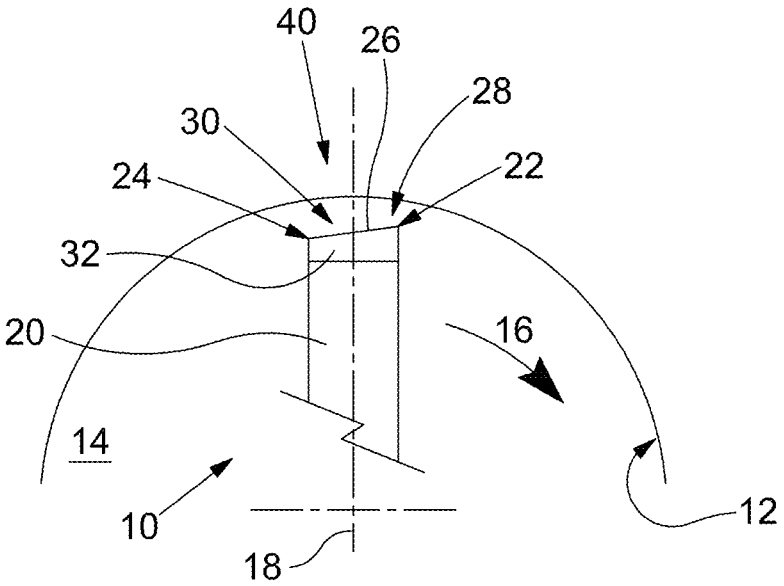
FIG. 1 is a downhole view schematically illustrating a current example of a knife during an initial stage of a downhole cutting operation.

The knife 110 has a different structure to that of the knife 10 of FIGS. 1-2. The knife 110 includes two spaced-apart blades 120 positioned respectively at a trailing side 124 and leading side 122 of the knife 110. The blade 120 at the trailing side 124 defines a first cutting element 136 of the knife 110 and the blade 120 at the leading side 122 defines a second cutting element 138 of the knife 110. The first and second cutting elements 136, 136 are disposed on a cutting side 140 of the knife 110, the cutting side 140 of the knife 110 being oriented so as to face an inner surface of a casing 112. When viewed downhole as illustrated by FIGS. 3*a-b* & 4, the first cutting element 136 extends to a radially outermost position of the knife 110 such that the first cutting element 136 initially cuts the casing 112 during the initial cutting operation of the knife 110, as illustrated by FIG. 3*a*. The second cutting element 138 is not involved in the cutting of the casing 112 during the initial cutting operation because only the first cutting element 136 is initially in contact with the casing 112.

The knife 110 of FIGS. 3*a*, 3*b* & 4 defines a positive rake angle, which in this example is in the form of a clearance angle 130 between the trailing side 124 and the leading side 122, with respect to a circumferential cutting direction 116 of the knife 110. The circumferential cutting direction 116 may define a rotation direction of the knife 110. During the initial cutting operation, the first cutting element 136 and the second cutting element 138 are staggered relative to each other such that the clearance angle 130, as best illustrated by FIG. 3*b*, can be defined between a cutting surface of the second cutting element 138, a cutting surface of the first cutting element 136 and an inner surface of the casing 112. The knife 110 is dressed with a wear-resistant material 132.

During use, the first cutting element 136 may eventually wear until the second cutting element 138 becomes involved in the cutting operation (e.g. after completion of the initial cutting operation), as illustrated by FIG. 4. The first cutting element 136 loses cutting effectiveness during the initial cutting operation due to this wearing away of the wear-resistant material 132, which may blunt the first cutting element 136. A bearing surface may be formed on the cutting side 140 of the first cutting element 136. Once the first cutting element 136 has sufficiently worn away, the blade 120 positioned at the leading side 122 (i.e. the second cutting element 138) then starts to cut the casing 112. Since the second cutting element 138 is effectively a "new" blade 120, the cutting effectiveness of the knife 110 may be improved over the cutting effectiveness of the worn first cutting element 136. The first cutting element 136 may or may not still contribute to the cutting of the casing 112. Once the second cutting element 138 starts to cut, the second cutting element 138 may provide a preferable angle of attack than the first cutting element 136. If a bearing surface forms on the cutting side 140 of the first cutting element 136 then the second cutting element 138 may provide improved cutting performance due to being positioned in front of a centre plane 118 of the knife 110, the centre plane 118 extending in a radial direction from, and axially along, the downhole apparatus. Since the second cutting element 138 leads while the knife 110 moves in the cutting direction 116, the second cutting element 138 cuts the casing 112 leaving a path for the first cutting element 136 to follow, while avoiding or minimising grinding of the first cutting element 136 against the casing 112. Any grinding of the blades 120 against the casing 112 may reduce the cutting efficiency of the operation due to the potential need to apply a greater force against the casing 112 while moving the knife 110 in the cutting direction 116 in order to achieve a desired cut.

Referring next to FIGS. 3*aa* & 4*a*, there is illustrated a knife 110*a* that is very similar to the knife 110 of FIGS. 3*a*, 3*b* & 4. However, in contrast to FIGS. 3*a*, 3*b* & 4, the knife 110*a* is shaped or oriented such that the blades 120*a* extend or protrude differently to that of the knife 110. In particular, the first cutting element 136*a*, which defines a trailing side 124*a* of the knife 110*a*, does not cut initially for the initial cutting operation. Instead, the second cutting element 138*a*, which defines a leading side 122*a* of the knife 110*a*, cuts first or initially for the initial cutting operation. After the initial cutting operation, the first cutting element 136*a* defining the trailing side 124*a* of the knife 110*a* starts to cut, while the second cutting element 138*a* defining the leading side 122*a* of the knife 110*a* may lose cutting effectiveness (e.g. during the initial cutting operation).

It will be appreciated that the cutting element for the initial cutting operation (e.g. one of the first and second cutting elements 136, 136*a*, 138, 138*a*) may extend or protrude further from the knife 110, 110*a*, than the cutting element for after the initial cutting operation (e.g. the other one of the first and second cutting elements 136, 136*a*, 138, 138*a*). The cutting element for the initial cutting operation may define either the leading or trailing side 122, 122*a*, 124, 124*a* of the knife 110, 110*a*, as appropriate. It will also be appreciated that movement of the first and second cutting elements 136, 136*a*, 138, 138*a* relative to the object may define a cutting plane of said first and second cutting elements 136, 136*a*, 138, 138*a*.

Figure 5A:
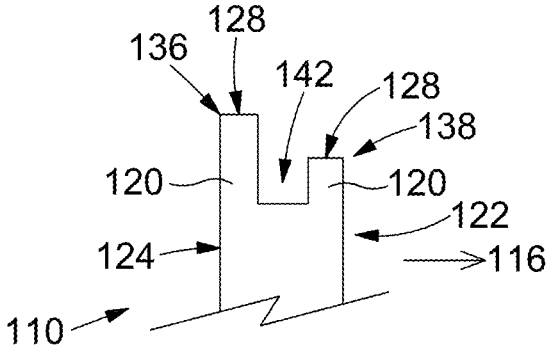
FIG. 5*a* is a further schematic downhole view of the knife of FIG. 3*a;*
Figure 5B:
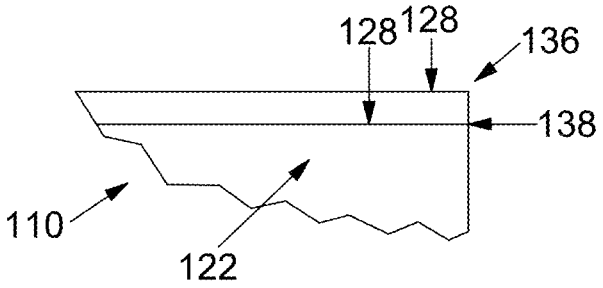
FIG. 5*b* is a side view of the knife of FIG. 3*a;*
Figure 5C:
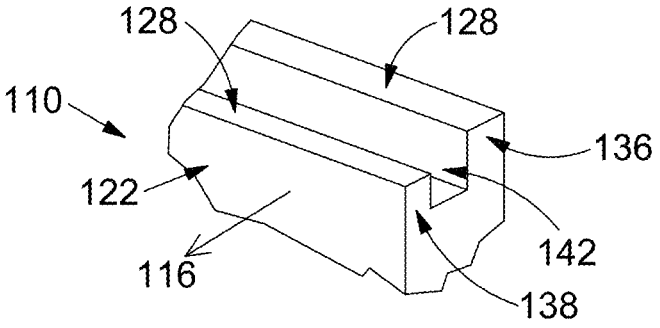
FIG. 5*c* is a perspective view of the knife of FIG. 3*a;*

As illustrated by FIGS. 5*a* & 5*c*, which show in greater detail the knife 110 of FIGS. 3*a*-*b* & 4, the blades 120 are spaced apart so as to define a space 142 therebetween. Thus, the blades 120 in this example are distinct or separate from each other so that the formation of a bearing surface is restricted to a smaller area across the cutting side 140, e.g. relative to the example of FIGS. 1-2.

FIGS. 6*a*-6*d* illustrate further examples of knives. In contrast to the examples of FIGS. 1-4, the knives 210 of FIGS. 6*a*-6*d* are designed for milling a downhole object in a downhole (e.g. axial) direction instead of cutting the inner surface of a casing in a radial direction. The reference signs for features of the knives 210 which are similar to features of the knives 10, 110, 110*a* of FIGS. 1-4 are incremented by 100 as appropriate.

Figure 6A:
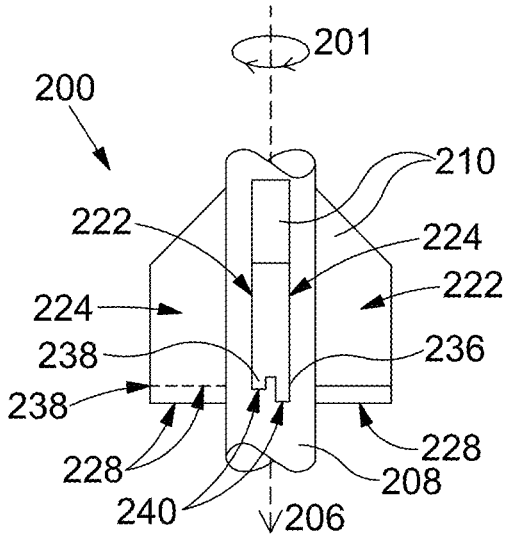
FIG. 6*a* is a side view of a milling tool according to an example of the present disclosure.
Figure 6B:
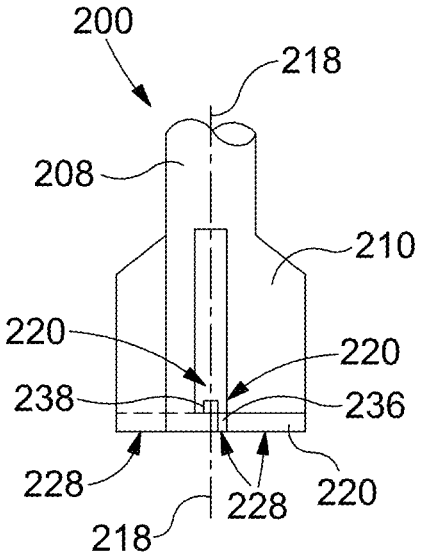
FIG. 6*b* is a side view of a milling tool according to a further example of the present disclosure.
Figure 6C:
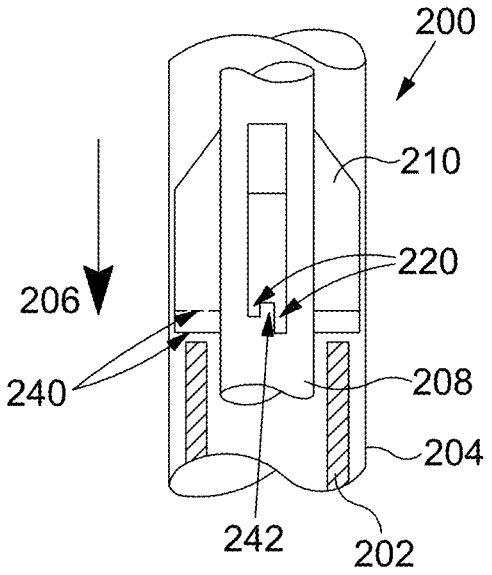
FIG. 6*c* is side view of the milling tool of FIG. 6*a* during a milling operation.
Figure 6D:
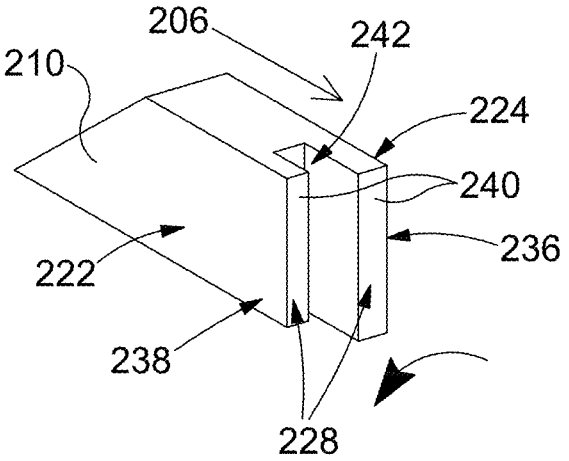
FIG. 6*d* is a perspective view of a knife of the milling tool of FIG. 6*a;*

FIGS. 6*a*-6*c* illustrate a mill 200 for milling a downhole object 202 (illustrated in FIG. 6*c*) such as a downhole tool, string component, drilling component, fish, junk, or the like. The mill 200 is provided within a washover pipe 204 which is positioned around the object 202. Fluid circulation through the washover pipe 204 while milling of the object 202 allows any debris created by the milling operation to be carried to surface through the washover pipe 204. The mill 200 is moved in a milling direction 206 (e.g. axially downhole) relative to the object 202 so as to advance the mill 200 and perform the milling operation. Each knife 210 includes two blades 220 which are similar to the blades 120 of knife 110, 110*a* of FIGS. 3*a*-5*c*.

The mill 200 in FIGS. 6*a*-6*c* each include four knives 210 which are oriented for cutting or milling in an axial direction (i.e. in the milling direction 206) instead of in a radial direction, as illustrated by FIGS. 1-4. It will be appreciated that any number of knives 210 could be used, for example, one, two, three, or more than four knives 210.

The knives 210 are circumferentially mounted, and equally spaced apart, around a tubular 208, which in this example forms part of a downhole apparatus (not shown) for moving the knives 210, in this case, for rotating the knives relative to the object 202. However, the principle of operation is similar to the knives of FIGS. 3-4 in that there is provided a first cutting element 236 at a trailing side 224 and a second cutting element 238 at a leading side 222 of each knife 210. The dashed lines in FIGS. 6*a*-6*c* represent the position of the second cutting element 238 behind or in front of the first cutting element 236, depending on the view of the knife 210 illustrated by FIGS. 6*a*-6*c*.

As the mill 200 rotates in a clockwise direction (see arrow 201) when viewed in a downhole direction (see arrow 206), the second cutting element 238 defines the leading side 222 and the first cutting element 236 defines the trailing side 224 during rotation of the mill 200 with the first cutting element 236 also providing an initial cutting surface 228. Once the first cutting element 236 wears down (i.e. after the initial cutting or milling operation), the second cutting element 238 starts to provide at least part of the cutting surface 228 during subsequent cutting or milling operations.

Similar to the example of FIGS. 3*a*-5*c*, there is provided a space 242 between first and second cutting elements 236, 238.

As illustrated by FIG. 6*b*, the knife 210 defines a centre plane 218 between the first and second cutting elements 236, 238 (in this case the centre plane 218 extends radially outwardly from, and axially along, the tubular 208). Similar to the example of the knife 110 of FIGS. 3*a*-5*c*, once the first cutting element 236 (which is to the rear of the centre plane 218) wears down sufficiently, the second cutting element 238 (which is to the front of the centre plane 218) leads the cut or mill of the downhole object 202. The second cutting element 238 may then cut more effectively because the second cutting element 238 may be sharper than the first cutting element 236.

It will be noted that in the present example the cutting surface 228 of each blade 220 is initially planar (and is perpendicular to the downhole direction 206) along a first cutting side 240 of each blade 220. During the cutting or milling operation, the blade 220 may only wear down in parts which correspond to size and shape of the downhole object 202 (illustrated by FIG. 6*c*). Therefore, the blades 220 may only wear down along a portion thereof which is contact with the downhole object 202, with the remaining portion of the blades 220 remaining planar.

The first cutting element 236 extends to an axially outermost position of each knife 210 so that the first cutting element 236 cuts or mills the object 202 during an initial cutting or milling operation and once the first cutting element 236 wears out, the second cutting element 238 starts to cut or mill the object 202. In FIGS. 6*a* & 6*c*, the mill 200 is mounted on the tubular 208 such that the tubular 208 extends axially either side of the knives 210. In FIG. 6*b*, the mill 200 is mounted on the tubular 208 such that the tubular 208 extends axially above (i.e. towards surface) the knives 210 but does not extend axially beyond (i.e. downhole of) the first and second cutting elements 236, 238 so as to define a flat-bottomed mill 200 (or a planar-bottomed mill 200). Both examples of the mill 200 work on the same principle that rotation of the knives 210 with respect to the object 202 causes milling of an end of the object 202 and movement of the mill 200 along the milling direction 206 allows the milling operation to continue as the object 202 is milled.

The knives 210 are mounted in any appropriate way on the tubular 208, for example, by welding, and/or being inserted within a slot in the tubular 208, the slot corresponding to an outer shape or perimeter of the knife 210, or the like.

Figure 7A:
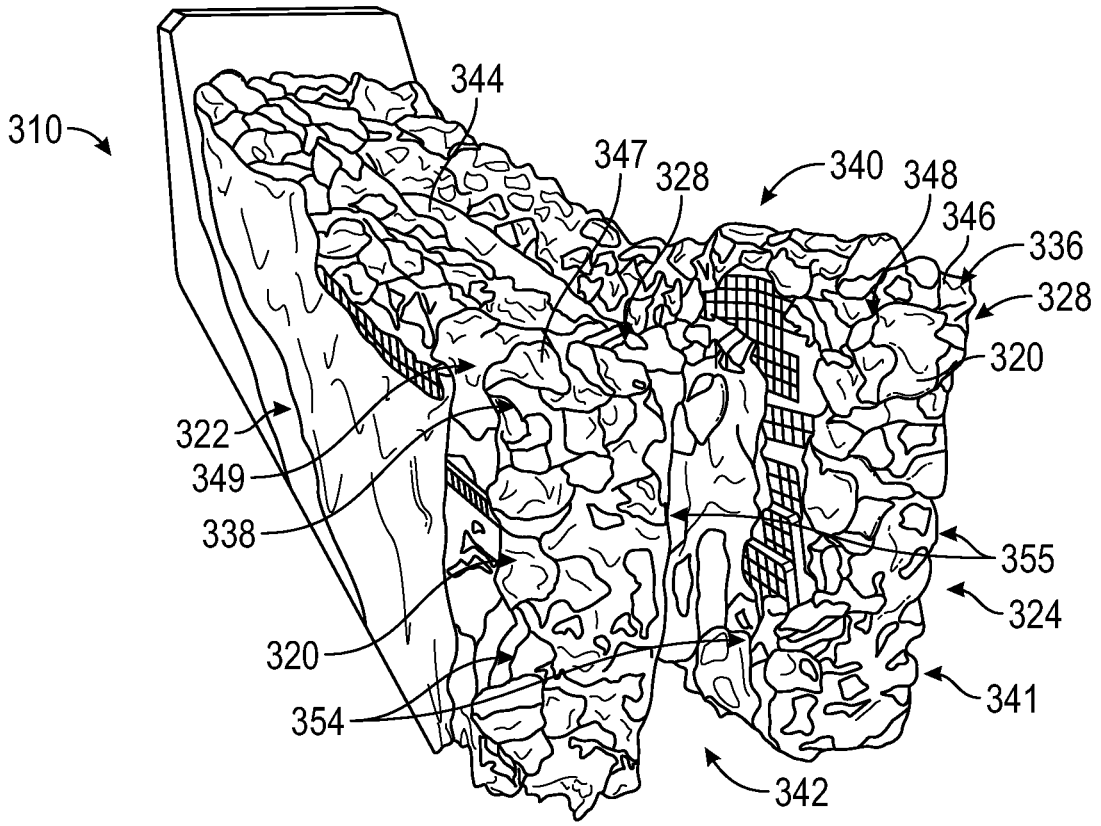
FIG. 7*a* is a perspective view photographic image of a knife according to an example of the present disclosure.
Figure 7B:
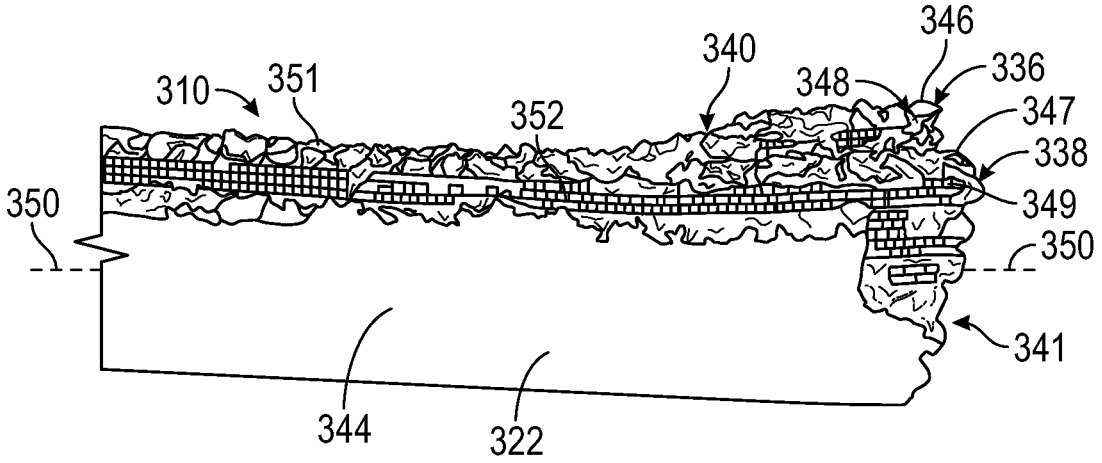
FIG. 7*b* is a side view photographic image of the knife of FIG. 7*a;*

FIGS. 7*a*-7*b* are photographic images of a knife 310, respectively showing a perspective view and side view, according to a further example of the present disclosure. The knife 310 is configured to perform a cutting operation in a radial direction (similar to the example illustrated by FIGS. 3*a*-5*c*) relative to a downhole apparatus (not shown) to which the knife 310 is mounted, but could be moved in a downhole direction while or after cutting in the radial direction to simultaneously or subsequently perform a milling operation (similar to the examples illustrated by FIGS. 6*a*-6*d*). During use, the knife 310 is moved into contact with a casing (not shown) and rotation of the knife 310 relative to the casing causes the knife 310 to cut into the casing. The principle of operation of the knife 310 is similar to the operation described in relation to FIGS. 3*a*-6*d*. The knife 310 includes two blades 320, similar to the examples described previously, in the form of a first cutting element 336 at a trailing side 324 and a second cutting element 338 at a leading side 322 of the knife 310. The first cutting element 336 defines both a radially outermost position of the knife 310 (with respect to the downhole apparatus) so that the first cutting element 336 defines a cutting surface 328 of the knife 310 and cuts the casing during an initial cutting operation. If the first cutting element 336 wears out, the second cutting element 338 starts to cut the casing after the initial cutting operation. The second cutting element 338 defines a further cutting surface 328 of the knife 310.

The knife 310 has a generally elongate body 344 with the blades 320 extending along at least a portion of a first cutting side 340 and a second cutting side 341 of the knife 310. Similar to the examples of FIGS. 3*a*-6*d*, the blades 320 are spaced apart and approximately or substantially parallel to each other so as to define a space 342 therebetween. The first cutting side 340 extends along an elongate side of the elongate body 344. The second cutting side 341 extends along an end of the elongate body 344 and is approximately perpendicular to the first cutting side 340. Depending on the positioning or orientation of the knife 310, one or both of the first and second cutting sides 340, 341 may contribute to the cutting operation. In the present example, a first corner portion 346 of the first cutting element 336 and a second corner portion 347 of the second cutting element 338 respectively provide cutting surfaces 328 of the knife 310. The first and second corner portions 346, 347 respectively define a first and second corner angle 348, 349 between the first cutting side 340 and second cutting side 341 of each respective blade 320.

In the present example, both of the first and second corner portions 346, 347 define an angle (i.e. the first and second corner angles 348, 349) between the first and second cutting sides 340, 341 that is an acute angle. However, there is a difference between the respective position of the first and second cutting elements 336, 338 such that the first corner portion 346 is staggered in position relative to the second corner portion 347. Further, the first corner portion 346 includes a first corner angle 348 which is less (e.g. defines a smaller or shallower angle) than the second corner angle 349 of the second corner portion 347. However, it will be appreciated that depending on the staggering of the respective first and second cutting elements 336, 338 that it may be possible for the first and second corner angles 348, 349 to have any appropriate angle to provide any desired position (e.g. outermost position) for the first and second corner portions 346, 347.

As best illustrated by FIG. 7*b*, the first and second cutting elements 336, 338 are staggered relative to each other such that the first corner portion 346 extends to an outermost position extending out of the first cutting side 340 of the knife (e.g. in a direction that is approximately perpendicular to the axis 350 defined along the elongate body 344) and the second corner portion 347 of the second cutting element 338 extends to an outermost position extending out of the second cutting side 341 of the knife 310 (e.g. in a direction that is approximately parallel to the axis 350).

The knife 310 is dressed in a wear-resistant material 332. Any appropriate technique may be used to dress the knife 310 with the wear-resistant material 332. In the example illustrated by FIGS. 7*a*-7*b*, the knife 310 includes a mesh 351, in this example a bronze mesh, including carbide (e.g. tungsten carbide) blocks for providing a "rough" surface texture. The mesh 351 is mounted to a plurality of anchors 352, which in this example are in the form of carbide inserts, which are mounted (e.g. welded), to the knife 310 so as to provide the cutting surfaces 328 of the first and second cutting elements 336, 338.

The anchors 352 are mounted on the knife so as to be oriented towards a leading direction defined by the movement of the knife 310 when in use downhole. Both the first and second cutting elements 336, 338 include leading faces 354 which include the anchors 352 and the mesh 351. The first cutting side 340 and the second cutting side 341 also include a plurality of anchors 351 to dress at least part of the first and second cutting sides 340, 341 with the wear-resistant material 332. The knife 310 also includes a number of trailing faces 355, which in this example are not dressed with the wear-resistant material 332 since this face is not substantially involved with the cutting operation.

Figure 8A:
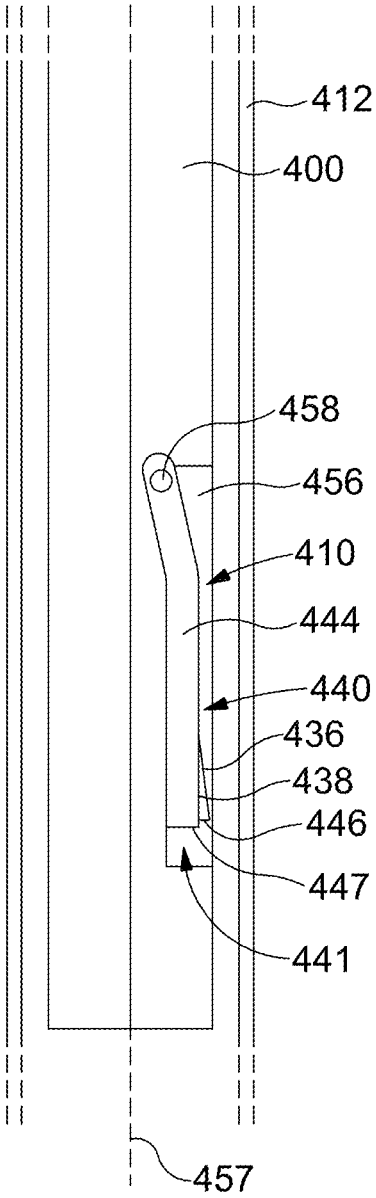
FIG. 8*a* is a part cutaway side schematic view of a casing cutter including a knife according to an example of the present disclosure before a casing cutting operation is carried out.
Figure 8B:
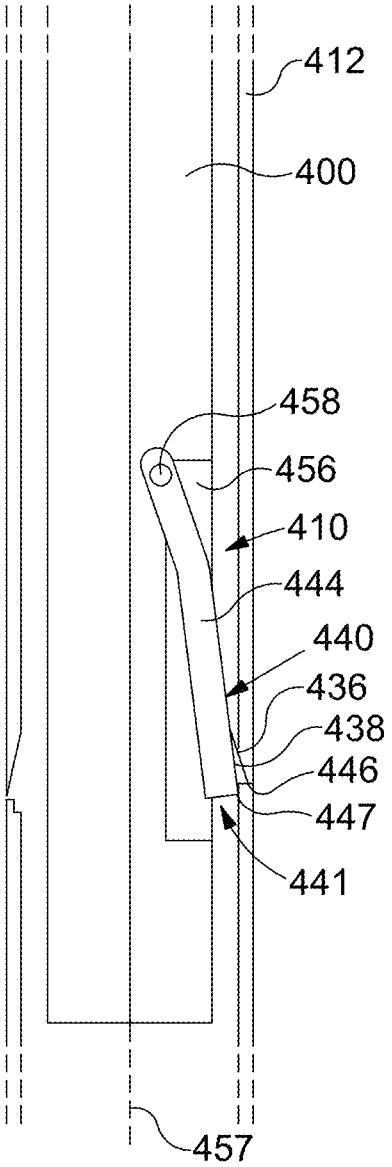
FIG. 8*b* is a part cutaway side schematic view of the casing cutter of FIG. 8*a* during the casing cutting operation.

Referring next to FIGS. 8*a*-8*d* there is shown a part cut-away side view of a downhole apparatus 400 for supporting a knife 410. In use, the downhole apparatus 400 is run downhole and located within a casing 412. The downhole apparatus 400 is rotatable with respect to the casing 412 so that the knife 410 can cut the casing 412 in a radial direction. The knife 410 shown in FIGS. 8*a*-8*b* is similar to the knife 310 shown in FIGS. 7*a*-7*b* (with the reference numeral of similar features of the knife 410 being incremented by 100 with respect to the knife 310), although it will be appreciated that any appropriate knife of the present disclosure could be used. The example of FIGS. 8*a*-8*b* only shows one knife 410, however it will be appreciated that two, three, four or more knives 410 could be provided on the same downhole apparatus 400, each knife 410 being operable either independently or in conjunction with each other.

The knife 410 includes a first cutting side 440 and a second cutting side 441, along which a first cutting element 436 and second cutting element 438 extend in a similar manner to the example illustrated by FIGS. 7*a*-7*b*. In FIG. 8*a*, the knife 410 is in a retracted position within a recess 456 of the downhole apparatus 400 so as to permit the downhole apparatus 400 to be moved within the wellbore (not shown) and within the casing 412. The knife 410 includes an elongate body 444 which is oriented in an axial direction 457 along the downhole apparatus 400 with a first cutting side 440 of the knife 410 being oriented to face radially outwardly of the downhole apparatus 400. The knife 410 further includes a second cutting side 441 which faces in a downhole direction when retracted within the recess 456.

Once the downhole apparatus 400 is moved to a desired location within the casing 412 the knife 410 can be moved to an extended position with respect to the downhole apparatus 400 so as to cut the casing 412 in a radial direction (i.e. with respect to the downhole direction). The knife 410 is mounted to the downhole apparatus 400 via a mount 458, in this example a pivotable mount or joint, located near to an opposite end of the elongate body 444 to the second cutting side 441. The downhole apparatus 400 includes a movement apparatus (not shown) configured to move the knife 410 between the retracted and extended positions by allowing the knife 410 to pivot about the mount 458. The mount 458 is arranged such that the knife 410 is moveable in a radial direction with respect to the downhole apparatus 400.

The knife 410 includes a first corner portion 446 and a second corner portion 447 disposed between the first cutting side 440 and the second cutting side 441. If the knife 410 is moved to the extended position, the first corner portion 446 contacts the casing 412 initially for an initial cutting operation, after which the second corner portion 447 also cuts into the casing 412, as illustrated by FIG. 8*b*. Once the casing 412 has been cut as illustrated by FIG. 8*b*, a portion of the casing 412 can be retrieved to surface.

As the knife 410 pivots relative to the downhole apparatus 400, the first and second corner portions 446, 447 are the first (and second) surfaces of the knife 410 to contact the casing 412. Since the corner portions 446, 447 may be generally sharper (e.g. by virtue of defining an acute angle less than 90 degrees, or the like) than other surfaces of the knife 410 (e.g. the first or second cutting sides 440, 441), the cutting operation may be more efficient in spite of there not being much permitted range of movement between the retracted and extended positions.

Figure 8C:
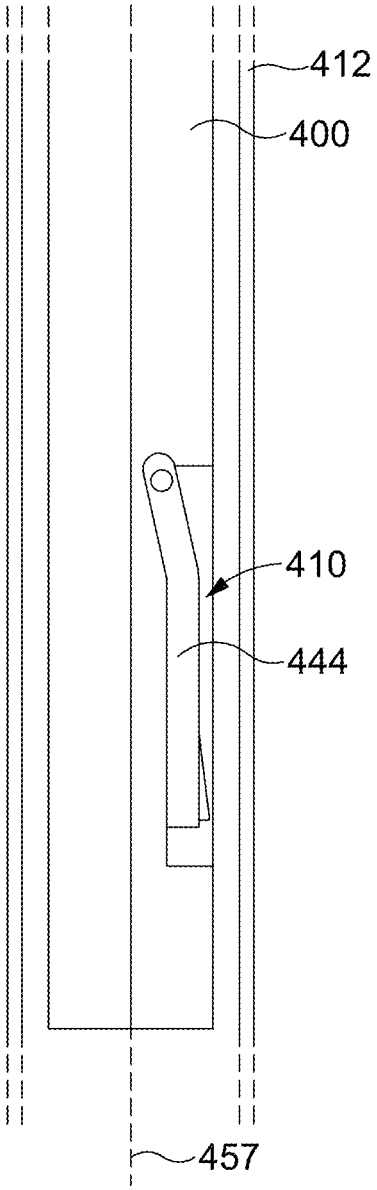
FIG. 8*c* is identical to FIG. 8*a* but provided for ease of comparison with FIG. 8*d;*
Figure 8D:
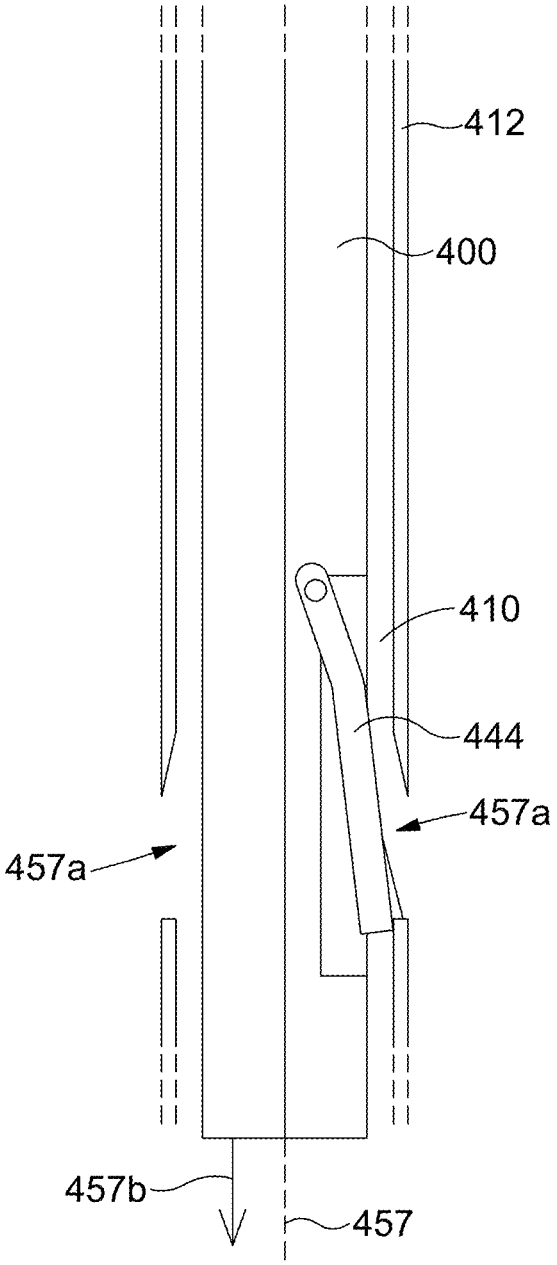
FIG. 8*d* is a part cutaway side schematic view of the casing cutter of FIG. 8*a* after at least partially completing the casing cutting operation of FIG. 8*b;*

FIGS. 8*c*-8*d* illustrate how radial movement of the downhole apparatus 400 has circumferentially cut the casing 412 while axial movement in the axial direction 457 downhole has axially cut (or milled) the casing 412 so as to define a radial and axial cut 457*a*. The length of the axial cut 457*a* substantially corresponds to axial movement 457*b* of the downhole apparatus 400, where FIG. 8*d* illustrates the downhole apparatus 400 as having moved downhole relative to the downhole apparatus 400 illustrated by FIG. 8*c*, which is identical to FIG. 8*a* for ease of comparison. Therefore, the knife 410 may provide at least one of: an axial and radial cut in an object depending on whether the knife 410 moves relative to the downhole object and/or whether the downhole apparatus 400 is moved axially within the casing 412.

FIGS. 9*a*-9*d* illustrate a knife 510 which is similar to the knife 310 of FIGS. 7*a*-7*b*. The knife 510 can be mounted to a downhole apparatus in any appropriate manner, for example, in a similar manner to the way that knife 410 is mounted to the downhole apparatus 400 of FIGS. 8*a*-8*b*. In addition, the principle of operation of the knife for cutting or milling may be similar to the principle of operation described in relation to FIGS. 8*a*-8*d*. The reference numerals for features of the knife 510 which are similar to the features of the knife 110, 210, 310 or 410, are incremented by 400, 300, 200, 100 as appropriate.

The knife 510 includes a first cutting side 540 and a second cutting side 541, along with a first cutting element 536 and second cutting element 538 which extend along the first and second cutting sides 540, 541 similar to the example illustrated by FIGS. 7*a*-7*b*. The first and second cutting elements 536, 538 each define a blade 520 of the knife 510. Further, the first cutting element 536 includes a trailing side 524 of the knife 510 and the second cutting element 538 includes a leading side 522 of the knife 510. The first cutting element 536 and second cutting element 538 are spaced apart and are generally parallel to each other so as to define a space 542 therebetween and extending at least partially along the first cutting side 540 and entirely along the second cutting side 541.

The knife 510 includes an elongate body 544 which defines an axial direction 557 of the knife 510. Similar to the example of FIGS. 8*a*-8*b*, the knife 510 is mountable to a downhole apparatus (not shown). The knife 510 further includes a second cutting side 541 which faces in a downhole direction (i.e. parallel to the axial direction 557) if the knife 510 is retracted in the downhole apparatus.

The knife 510 is mounted to the downhole apparatus via a mount 558. In this example the mount 558 is in the form of a cylindrical opening 559 configured to receive a pin (not shown) for attaching the knife 510 to the downhole apparatus and permitting the knife 510 to pivot about the mount 558. The knife 510 includes a cam 560 disposed at the opposite end of the elongate body 544 to the second cutting side 541. The knife 510 is moved between a retracted and an extended position relative to the downhole apparatus by virtue of a force applied to the cam 560 by a movement apparatus (not shown) disposed within the downhole apparatus so that the knife 510 can pivot about the mount 558.

Figure 9D:
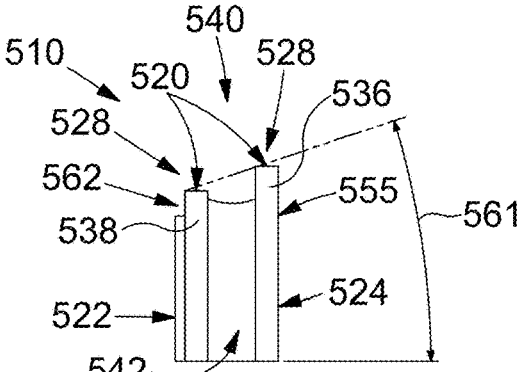
FIG. 9*d* is a further side view of the knife of FIG. 9*a;*

The knife 510 further includes a first corner portion 546 associated with the first cutting element 536 and a second corner portion 547 associated with the second cutting element 538, the first and second corner portions 546, 547 being disposed between the first cutting side 540 and the second cutting side 541. The first corner portion 546 defines a first corner angle 548 and the second corner portion 547 defines a second corner angle 549. As best illustrated by FIG. 9*d*, the first cutting element 536 along the second cutting side 541 is longer than the second cutting element 538, also along the second cutting side 541. The first corner portion 546 is staggered relative to the second corner portion 547 such that the first corner portion 546 defines an initial cutting surface 528 of the knife 510 for an initial cutting operation.

Figure 9C:
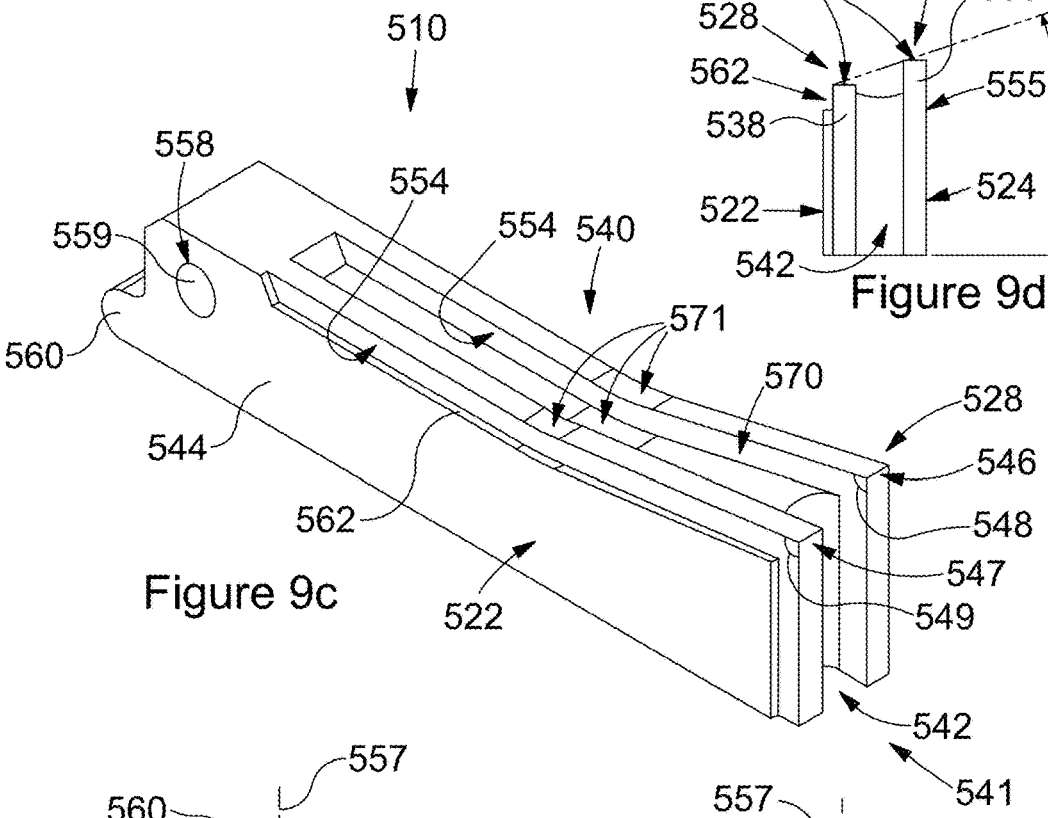
FIG. 9*c* is a perspective view of the knife of FIG. 9*a;*

FIG. 9*c* illustrates the first and second corner angles 548, 549 as being acute angles so as to define a bevelled portion 570 extending from the first and second corner portions 546, 547 along a portion of the first cutting side 540, towards a bevel transition portion 571 defined by each of the first and second cutting elements 536, 538 part-way along the first cutting side 540. The bevel transition portion 571 defines a change in the angle of the first and second cutting elements 536, 538 along the first cutting side 540 so that a non-bevelled portion 572 of the first cutting side 540 that is proximal to the mount 558 and cam 560 (but distal from the second cutting side 541) is parallel to a base 573 of the knife 510. The base 573 of the knife 510 extends between the cam 560 and the second cutting side 541 and defines a non-cutting side of the knife 510. The bevelled portion 570 is proximal to the second cutting side 541 (but distal from the mount 558 and cam 560) and is non-parallel to the base 573 of the knife 510. It will be appreciated that the location of the bevel transition portion 571 along the first cutting side 540 can vary depending on requirements. The staggering of the first and second corner portions 546, 547 relative to each other defines a positive rake angle 561 therebetween, as best illustrated by FIG. 9*d*.

The knife 510 further includes a ridge 562 between the second cutting element 538 and the leading side 522, the ridge 562 extending along the knife 510 and being approximately or substantially parallel to the space 542 (e.g. the second cutting element 538 extends along the first and second cutting sides 540, 541 between the ridge 562 and the space 542). The ridge 562 is configured to provide an anchor for the wear-resistant material such as a mesh, e.g. as described in relation to FIGS. 7*a*-7*b*.

Both the first and second cutting elements 536, 538 include leading faces 554 which include the anchors similar to those described in relation to FIGS. 7*a*-7*b*. Both of the first and second cutting elements 536, 538 also include a trailing face 555, which does not necessarily need to include wear-resistance material, but may optionally do so.

Figure 9A:
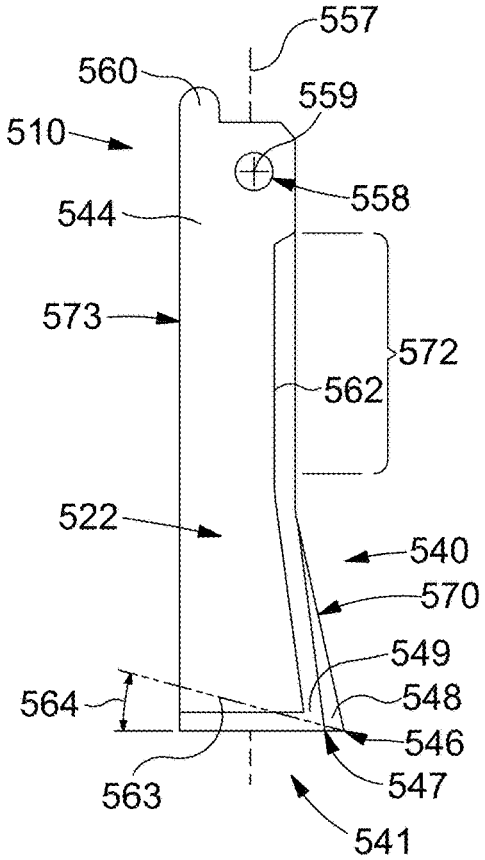
FIG. 9*a* is a side view of a knife according to an example of the present disclosure.

FIGS. 9*a*-9*d* illustrate the first and second cutting elements 536, 538 as including surfaces which are approximately perpendicular to each other. However, some of the surfaces may be angled relative to each other so as to define a bevelled surface to provide sharper edges for the cutting operation. By way of example, FIG. 9*a* illustrates a dash-dotted line extending along the second cutting side 541 of the knife 510 and indicating the potential position or plane of a first bevelled surface 563 defining the second cutting side 541 of the knife 510. The first bevelled surface 563 defines a relief rake angle 564 for defining smaller (or shallower) first and second corner angles 548, 549 such that the first and second corner portions 546, 547 (according to the first bevelled surface 563) are sharper than the example illustrated by the solid lines in FIG. 9*a*.

Figure 9B:
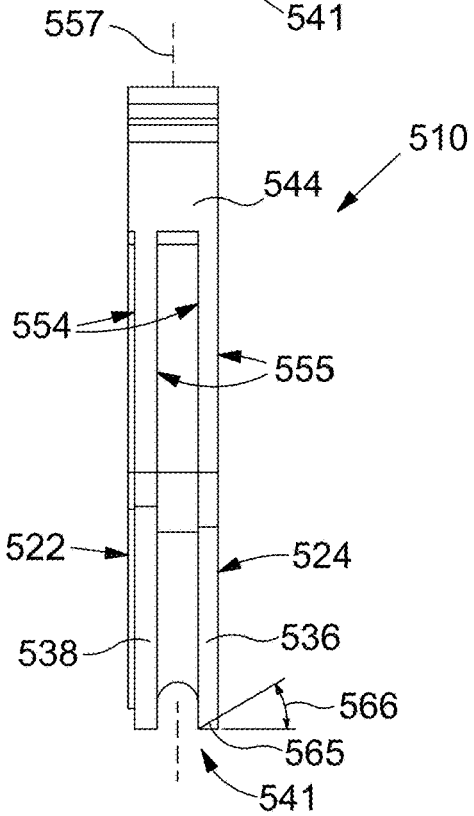
FIG. 9*b* is a further side view of the knife of FIG. 9*a;*

FIG. 9*b* illustrates a further dash-dotted line defining a second bevelled surface 565 which extends along the second cutting side 541 of the first cutting element 536 and extending between the leading face 554 and the trailing face 555 of the first cutting element 536. The second bevelled surface 565 defines a relief rake angle 566 for defining a negative rake angle such that the first cutting element 536 has a larger angle of attack than the example illustrated by the solid lines in FIG. 9*b*.

FIGS. 10*a*-10*d* illustrate a knife 610 for mounting to a downhole apparatus in a similar manner to that described in relation to the knife 510 of FIGS. 9*a*-9*d*. The reference numerals for features of the knife 610 which are similar to the features of the knife 110, 210, 310, 410 or 510, are incremented by 500, 400, 300, 200, 100 as appropriate.

The knife 610 includes a first cutting side 640 and a second cutting side 641, along with a first cutting element 636 and second cutting element 638 which extend along the first and second cutting sides 640, 641.

The first and second cutting elements 636, 638 each define a blade 620 of the knife 610. Further, the first cutting element 636 includes a trailing side 624 of the knife 610 and the second cutting element 638 includes a leading side 622 of the knife 610. The first cutting element 636 and second cutting element 638 are spaced apart and are generally parallel to each other, but in contrast to the example of FIGS. 9*a*-9*d*, the knife 610 further includes two intermediate cutting elements 637 disposed between the first and second cutting elements 636, 638. The two intermediate cutting elements 637 each define an additional blade 620 of the knife 610. Additionally, a space 642 extends along the second cutting side 641 between adjacent cutting elements 636, 637, 638. In this example, the spaces 642 include a recess formed within (and extending along) the second cutting side 641 of the intermediate and second cutting elements 637, 638. In contrast to the example of FIGS. 9*a*-9*d*, the spaces 642 along partially extend along the first cutting side 640 only.

The knife 610 includes an elongate body 644 which defines an axial direction 657 of the knife 610. Similar to the example of FIGS. 9*a*-9*d*, the knife 610 is mountable to a downhole apparatus with the first cutting side 640 of the knife 610 being oriented to face radially outwardly of the downhole apparatus. The knife 610 further includes a second cutting side 641 which faces in a downhole direction (i.e. parallel to the axial direction 657) when the knife 610 is retracted in the downhole apparatus.

The knife 610 is mounted to the downhole apparatus via a mount 658, as described in relation to FIGS. 9*a*-9*d*. The knife 610 includes a cam 660 disposed at the opposite end of the elongate body 644 to the second cutting side 641. The knife 610 is moved between a retracted and an extended position in a similar manner to that described in relation to the example of FIGS. 9*a*-9*d*.

The knife 610 further includes a first corner portion 646 associated with the first cutting element 636 and a second corner portion 647 associated with the second cutting element 638, the first and second corner portions 646, 647 being disposed between the first cutting side 640 and the second cutting side 641. The first corner portion 646 defines a first corner angle 648 and the second corner portion 647 defines a second corner angle 649. In this example, the knife 610 also includes two intermediate corner portions 667 disposed on the two intermediate cutting elements 637 and between the first and second corner portions 646, 647. The intermediate corner portions 667 each define an intermediate corner angle 668. Thus, the first, intermediate and second corner portions 646, 667, 647 define a row or array of corner portions. In this example, each of the first, intermediate and second corner angles 648, 668, 649 define the same angle. FIG. 10*c* illustrates said corner angles 648, 668, 649 as being approximately 90 degrees.

The first cutting side 640 (which includes the first, intermediate and second cutting elements 636, 637, 638) is parallel to a base 673 of the knife 610, the base 610 extending between the cam 660 and the second cutting side 641 of the knife and further defining a non-cutting side of the knife 610.

As best illustrated by FIG. 10*d*, the first cutting element 636 along the second cutting side 641 is longer than the second cutting element 638, also along the second cutting side 641. However, the two intermediate cutting elements 637 are both shorter than the first cutting element 636 and longer than the second cutting element 638 along the second cutting side 641. The intermediate cutting elements 637 each define different lengths along the second cutting side 641, with the intermediate cutting element 637 adjacent to the second cutting element 638 being shorter than the intermediate cutting element 637 adjacent to the first cutting element 636.

In this example, each of the first, intermediate and second cutting elements 636, 637, 638 define a step 669 (or a stepped profile) extending at least partially along the first cutting side 640 of the knife 610, and terminating at the second cutting side 641 thereof. The second cutting side 641 of the knife 610 defines an edge of the steps 669, which in this example includes the first, intermediate and second corner portions 646, 667, 647 of the knife 610. Each step 669 is connected to an adjacent step 669. Each of the steps 669 defines at least part of the first cutting side 640 of the knife 610, wherein each of said steps 669 includes a face of the first cutting side 640. The step 669 defined by the first cutting element 636 defines an initial cutting surface 628 of the knife 610 for the initial cutting operation. The steps 669 defined by the intermediate and second cutting elements 637, 638 define further cutting surfaces 628 of the knife 610 for after the initial cutting operation.

The first, intermediate and second cutting elements 636, 637, 638 also include leading faces 654 which include the anchors similar to those described in relation to FIGS. 7*a*-7*b*. The knife 610 also includes a trailing face 655 defined along the trailing side 624 of the knife 610. The leading faces 654 extend between the faces of the first cutting side 640 defined by each of the steps 669. In this example, the leading faces 654 are perpendicular to the faces of the first cutting side 640.

The first, intermediate and second cutting elements 636, 637, 638 may be regarded as being staggered relative to each other so as to define a stepped or step-like formation, as best illustrated by FIG. 10*c*. In addition, the first, intermediate and second corner portions 646, 667, 647 may be regarded as being staggered relative to each other in a step-like or stepped formation, as best illustrated by FIGS. 10*c*-10*d*.

The first corner portion 646 is staggered or stepped in terms of position relative to the intermediate corner portions 667 and the second corner portion 647 such that the first corner portion 646 defines an initial cutting surface 628 of the knife 610 for an initial cutting operation, while the intermediate corner portions 667 and second corner portion 647 defines subsequent cutting surfaces 628 of the knife 610 for after the initial cutting operation.

The staggering or stepping of the first, intermediate and second corner portions 646, 667, 647 relative to each other defines a positive rake angle 661 therebetween, as best illustrated by FIG. 10*d*.

The knife 610 further includes a ridge 662 between the second cutting element 638 and the leading side 622, the ridge 662 extending along the knife 610 in a similar manner as described in relation to the example of FIGS. 9*a*-9*d*

FIGS. 10*a*-10*d* illustrate the first, intermediate and second cutting elements 636, 637 638 as including surfaces which are approximately perpendicular to each other. However, some of the surfaces may be angled relative to each other so as to define a bevelled surface to provide sharper edges for the cutting operation. By way of example, FIG. 10*a* illustrates a dash-dotted line extending along the second cutting side 641 of the knife 610 and indicating the potential position or plane of a first bevelled surface 663 defining the second cutting side 641 of the knife 610. The first bevelled surface 663 defines a relief rake angle 664 for defining smaller (or shallower) first, intermediate and second corner angles 648, 668, 649 such that the first, intermediate and second corner portions 646, 667, 647 (according to the first bevelled surface 663) are sharper than the example illustrated by the solid lines in FIG. 10*a*.

FIG. 10*b* illustrates a further dash-dotted line defining a second bevelled surface 665 which extends along the second cutting side 641 of the first cutting element 636 and extending between the leading face 654 and the trailing face 655 of the first cutting element 636. The second bevelled surface 665 defines a relief rake angle 666 for defining a negative rake angle such that the first cutting element 636 has a larger angle of attack than the example illustrated by the solid lines in FIG. 10*b*.

FIGS. 11*a*-11*d* illustrate a knife 710 which is similar to the knife 610 of FIGS. 10*a*-10*d* and also has some features which are similar to the knife 510 of FIGS. 9*a*-9*d*. Unless described otherwise, the features of the knife 710 may be understood by the person of ordinary skill in the art as being identical or similar to the features of the knife 610. The knife 710 can be mounted to a downhole apparatus in a similar manner to that described in relation to the knife 510 of FIGS. 9*a*-9*d*. The reference numerals for features of the knife 710 which are similar to the features of the knife 110, 210, 310, 410, 510 or 610, are incremented by 600, 500, 400, 300, 200, 100 as appropriate.

Figure 11D:
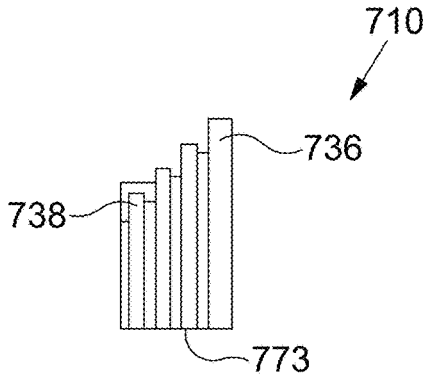
FIG. 11*d* is a further side view of the knife of FIG. 11*a;*
Figure 11C:
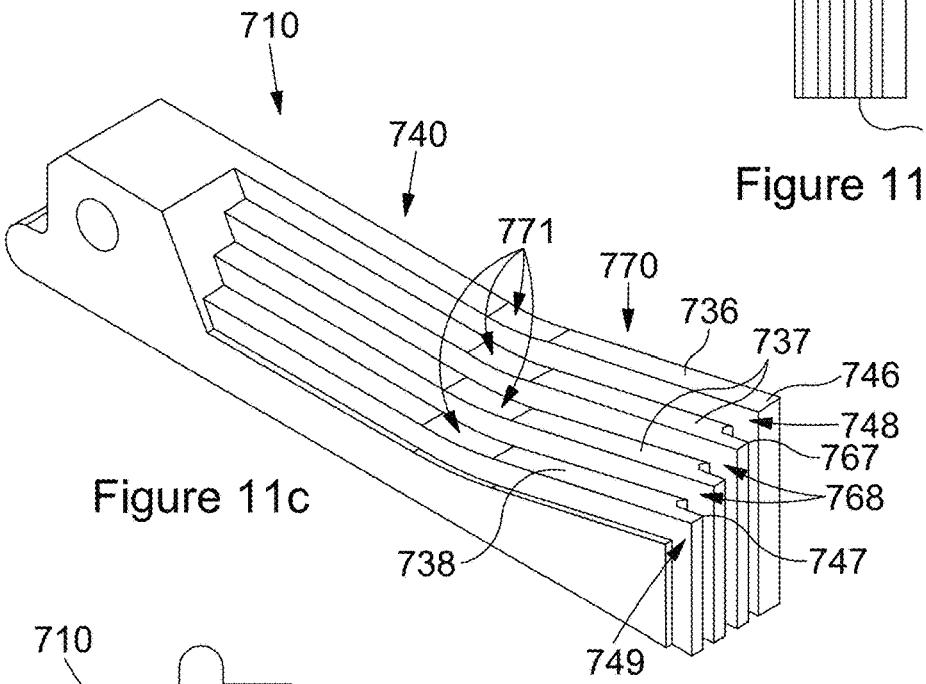
FIG. 11*c* is a perspective view of the knife of FIG. 11*a;*
Figure 11A:
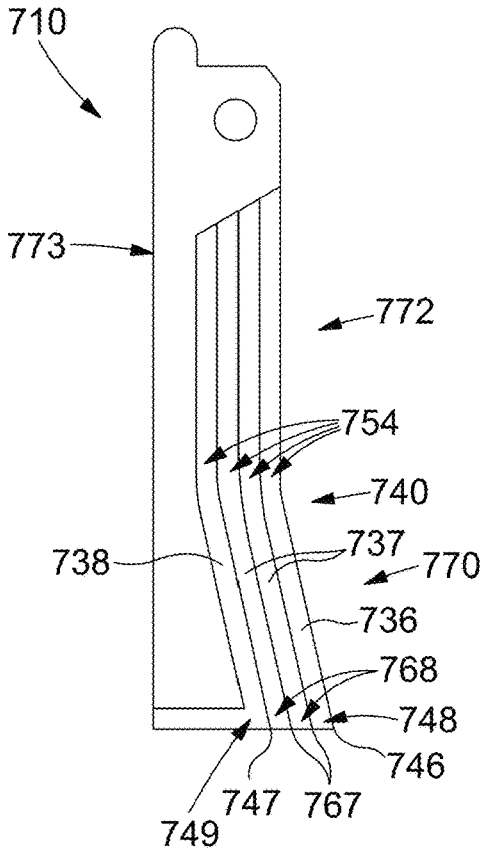
FIG. 11*a* is a side view of a knife according to an example of the present disclosure.
Figure 11B:
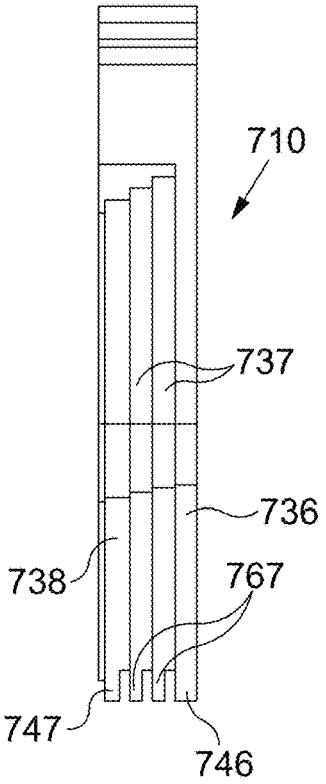
FIG. 11*b* is a further side view of the knife of FIG. 11*a;*

In contrast to the example illustrated by FIG. 10*c* (which shows the corner portions 646, 667, 647 having corner angles 648, 668, 649 as having acute angles which are approximately 90 degrees), FIG. 11*c* illustrates that the knife 710 includes first, intermediate and second corner portions 746, 767, 747 having corresponding corner angles 748, 768, 749 which define acute angles which are less than 90 degrees so as to define a bevelled portion 770 extending from the first, intermediate and second corner portions 746, 767, 747 along a portion of the first cutting side 740, towards a bevel transition portion 771 similar to the example of FIGS. 9*a*-9*d*. The bevel transition portion 771 defines a change in the angle of the first, intermediate and second cutting elements 736, 737, 738 along the first cutting side 740 so that a non-bevelled portion 772 of the first cutting side 740 is parallel to a base 773 of the knife 710, similar to the example of FIGS. 9*a*-9*d*. The first, intermediate and second cutting elements 736, 737, 738 also include leading faces 754 similar to those described in relation to FIGS. 7*a*-7*b*. However, the leading faces 754 extending along the leading side 722 of the knife 710 substantially correspond in shape to the bevelled portion 770 and the non-bevelled portion 771.

FIGS. 11*a*-11*d* illustrate the first, intermediate and second cutting elements 736, 737 738 as including some surfaces which are approximately perpendicular to each other (others include an angle such as the acute angle between the first and second cutting sides 740, 741). However, some of the surfaces may be angled relative to each other so as to define a further bevelled surface to provide sharper edges for the cutting operation, similar to the example of FIGS. 10*a*-10*d*.

The examples described in the present disclosure may be modified or adapted in any appropriate way. Any feature of any example, aspect or embodiment may be combined with any other example, aspect or embodiment of the knife described in the present disclosure.

FIGS. 9*a*-9*d*, 10*a*-10*d* and FIGS. 11*a*-11*d* illustrate the knife 510, 610, 710 as including generally planar surfaces. However, the knife 510, 610 710 may be dressed with a wear-resistant material (or may itself be formed of or include a wear-resistant material) similar to the manner described in relation to FIGS. 7*a*-7*d*. Thus, once suitably dressed, the knife 510, 610 710 may have a similar outer surface texture to the surface texture described and depicted by the knife 310 of FIGS. 7*a*-7*b*.

Any appropriate surface of the knife described in any of the examples may include an appropriate relief rake angle defining a bevelled surface, which may provide a sharper or blunter cutting surface and/or a certain (e.g. a larger or smaller, positive or negative) angle of attack.

It will be appreciated as the knife moves (e.g. is extended radially outwardly, the definition of the outermost portion or surface of the knife may change depending on the manner in which the knife moves. For example in FIGS. 8*a*-8*b* (and similarly in other examples described herein) the knife 410 pivots away from the downhole apparatus 400 at a relatively small angle such that the first corner portion 446 defines the outermost surface of the knife 410 with respect to the downhole apparatus 400 throughout the cutting operation. However, in some examples the knife may pivot at a relatively large angle, e.g. up to 90 degrees relative to the axis of the downhole apparatus 400 (e.g. if there is sufficient space between downhole apparatus 400 and the casing 412). In this case, the second cutting side 441 would instead define at least part of the outermost surface of the knife 410 with respect to the downhole apparatus 400 (and as such the second cutting side 441 would be oriented radially similar to the example illustrated by FIGS. 3*a*-4).

In an example the knife need not be pivoted or moveable. For example, the knife may be provided in the form of a milling tool which may include at least one fixed or fixed orientation blade arranged to provide cutting or milling in an axial direction (e.g. in the downhole direction such as illustrated by FIGS. 6*a*-6*c*), the at least one blade including at least one first and second cutting element arranged in a manner similar to that described in relation to the examples of the present disclosure.

Although a knife is described in the examples, the principles of the present disclosure could be applied to any form of cutting or milling apparatus. In an example, the cutting apparatus could include at least one cutting element arranged such that a first cutting element defines a trailing side and a second cutting element defines a leading side (i.e. in contrast to the arrangement described in the other examples in this description), wherein the first cutting element is configured to provide an initial cutting or milling operation before being worn down so that the second cutting element (and/or at least one intermediate cutting element) can provide a subsequent cutting or milling operation so that the cutting apparatus can last longer than would otherwise be expected. In this case, a bearing surface may form on the leading cutting element (i.e. the first cutting element) which would cut the path for the trailing cutting element or elements. However, any feature of any example described herein could be included in this example.

In another example, the knife of any example described herein may be configured to move in the opposite direction (i.e. anticlockwise when viewed downhole). However, at least one feature of any example, aspect or embodiment of the present disclosure could be included in this example.

The invention claimed is:

1. A knife for a rotary cutting tool, the knife comprising:
an arm including:
a first end having a mount for pivotally mounting the knife to the downhole rotary cutting tool such that the knife is pivotable between extended and retracted positions;
a second end distal from the first end; and
a cutting face between the first and second ends, the cutting face orientated to face an object to be cut when the arm is mounted to the downhole cutting tool;
a leading blade on the arm and extending a first distance from the cutting face; and
a trailing blade on the arm, the trailing blade:
separated from the leading blade by a gap,
positioned behind the leading blade with respect to an operational direction of rotation of the rotary cutting tool, and
extending to a second distance from the cutting face, the second distance greater than the first distance;
wherein at an initiation of cutting the object, the trailing blade cuts the object before the leading blade makes cutting contact with the object.

2. The knife of claim 1, wherein the trailing and leading blades are disposed at a tip of the arm.

3. The knife of claim 1, wherein the arm and blades of the knife are formed as a one-piece structure.

4. The knife of claim 1, wherein the knife defines a center plane between the leading and trailing blades.

5. The knife of claim 4, wherein the trailing blade is positioned behind the center plane with respect to the operational direction of rotation of the rotary cutting tool, and the leading blade is positioned in front of the center plane with respect to the operational direction of rotation of the rotary cutting tool.

6. The knife of claim 1, wherein the trailing blade is configured to initially engage the object at the initiation of cutting the object such that a separation gap is defined between the object and the leading blade, wherein in use, the separation gap decreases until the leading blade engages the object.

7. The knife of claim 1, wherein the trailing blade defines a first outermost cutting surface of the knife with respect to the mount, the first outermost cutting surface of the knife being configured to engage the object at the initiation of cutting the object.

8. The knife of claim 7, wherein the leading blade comprises a second outermost cutting surface that is closer to the mount than the first outermost cutting surface so that upon the trailing blade being worn down by use, the first and second outermost cutting surfaces are equally spaced from the mount.

9. The knife of claim 1, wherein the trailing blade is moveable relative to the object during use so as to define a first cutting plane, and the leading blade is moveable relative to the object during use so as to define a second cutting plane, wherein the first cutting plane is substantially the same as the second cutting plane.

10. The knife of claim 1, wherein the knife is configured to cut the object within a wellbore in a direction selected from a group consisting of: an axial cutting direction aligned with a longitudinal axis of the wellbore, a radial cutting direction transverse to the longitudinal axis of the wellbore, and both the axial cutting direction and the radial cutting direction.

11. The knife of claim 10, wherein the knife cuts the object by movement of the knife in the operational direction of rotation of the rotary cutting tool and movement of the knife in the direction selected from the group consisting of: the axial cutting direction, the radial cutting direction, and both the axial and radial directions.

12. The knife of claim 1, wherein the trailing and leading blades are circumferentially spaced apart from each other with respect to the operational direction of rotation of the rotary cutting tool.

13. The knife of claim 1, wherein in use, the trailing blade wears until a cutting surface of the trailing blade substantially matches a shape of an inner surface of the object during the initiation of cutting the object.

14. The knife of claim 1, wherein at least one of the trailing or leading blades comprises at least one step, wherein the at least one step connects the trailing blade to the leading blade, and wherein the at least one step defines at least part of at least one of the trailing or leading blades.

15. The knife of claim 1, wherein the knife is moveable by a first distance into contact with the object by moving a portion of the knife relative to the mount by a second distance, wherein the first distance is greater than the second distance.

16. The knife of claim 1, further comprising at least one intermediate blade disposed between the trailing and leading blades, the at least one intermediate blade being configured to cut the object after the trailing blade makes cutting contact with the object.

17. The knife of claim 16, wherein the intermediate blade is configured to cut the object before the leading blade makes cutting contact with the object.

18. A downhole apparatus comprising:

a body; and a knife coupled to the body by a mount such that the knife is pivotable between extended and retracted positions, the knife comprising:

an arm including:

a first end having the mount;

a second end distal from the first end; and a cutting face between the first and second ends, the cutting face orientated to face an object to be cut;

a leading blade on the arm and extending a first distance from the cutting face; and a trailing blade on the arm, the trailing blade:

separated from the leading blade by a gap, positioned behind the leading blade with respect to an operational direction of rotation of the rotary cutting tool, and extending to a second distance from the cutting face, the second distance greater than the first distance;

wherein at an initiation of cutting the object, the trailing blade cuts the object and becomes worn before the leading blade makes cutting contact with the object.

19. A method of performing a downhole operation in a wellbore, comprising:

providing a rotary cutting tool having a knife coupled to a body of the rotary cutting tool by a mount such that the knife is pivotable between extended and retracted positions, the knife including:

an arm having:

a first end having the mount;

a second end distal from the first end; and a cutting face between the first and second ends, the cutting face orientated to face a downhole object to be cut; and a trailing blade and a leading blade extending from the cutting face and separated by a gap, such that the trailing blade is positioned behind the leading blade with respect to an operational direction of rotation of the rotary cutting tool, and the trailing blade initially extends further from the cutting face than the leading blade;

engaging the trailing blade with the downhole object; and moving the knife in the operational direction of rotation so that the trailing blade cuts the downhole object and becomes worn before the leading blade cuts the downhole object.

20. The method of claim 19, wherein the downhole operation is milling operation.

* * * * *